US010025217B2

(12) United States Patent
Kimura et al.

(10) Patent No.: US 10,025,217 B2
(45) Date of Patent: Jul. 17, 2018

(54) CARTRIDGE AND IMAGE FORMING APPARATUS

(71) Applicant: CANON KABUSHIKI KAISHA, Tokyo (JP)

(72) Inventors: Takashi Kimura, Tokyo (JP); Yu Fukasawa, Nagareyama (JP); Tachio Kawai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/052,045

(22) Filed: Feb. 24, 2016

(65) Prior Publication Data

US 2016/0252878 A1 Sep. 1, 2016

(30) Foreign Application Priority Data

Feb. 27, 2015 (JP) ..... 2015-038380

(51) Int. Cl.
*G03G 15/02* (2006.01)
*G03G 21/18* (2006.01)

(52) U.S. Cl.
CPC ..... *G03G 15/025* (2013.01); *G03G 15/0216* (2013.01); *G03G 21/181* (2013.01); *G03G 21/1803* (2013.01); *G03G 21/1814* (2013.01)

(58) Field of Classification Search
CPC ..... G03G 21/181; G03G 21/1821
USPC ..... 399/176
See application file for complete search history.

(56) References Cited

U.S. PATENT DOCUMENTS 5,666,608 A * 9/1997 Christensen ..... G03G 15/025 399/115
6,385,420 B1 * 5/2002 Morioka ..... G03G 15/0216 399/115
7,058,337 B2 * 6/2006 Hashimoto ..... G03G 21/1825 399/111
7,463,844 B2 * 12/2008 Hashimoto ..... G03G 21/1821 399/111

(Continued)

FOREIGN PATENT DOCUMENTS

JP 2002-311690 A 10/2002
JP 2003-76117 A 3/2003

(Continued)

*Primary Examiner* — David M Gray
*Assistant Examiner* — Andrew V Do
(74) *Attorney, Agent, or Firm* — Canon U.S.A., Inc. IP Division

(57) ABSTRACT

A cartridge includes a first maintaining member and a second maintaining member, each disposed on respective end portions of a charging roller in an axial direction of the charging roller and configured to maintain a position of the charging roller at a first position, and a first moving portion and a second moving portion, each disposed on respective end portions of an image bearing member in an axial direction of the image bearing member and configured to respectively abut on and move the first and second maintaining members according to rotation of the image bearing member so as to move the charging roller from the first position to the second position. When the image bearing member is rotated in which the charging roller is in the first position, the first moving portion abuts on the first maintaining member, and then the second moving portion abuts on the second maintaining member.

14 Claims, 17 Drawing Sheets

(56) References Cited

U.S. PATENT DOCUMENTS

| | | | | |
|---|---|---|---|---|
| 8,210,530 | B1 * | 7/2012 | Gayne | G03G 15/0189 271/273 |
| 2005/0069342 | A1 * | 3/2005 | Kanno | G03G 21/1825 399/111 |
| 2007/0248382 | A1 * | 10/2007 | Oguma | G03G 15/0216 399/167 |
| 2011/0280621 | A1 * | 11/2011 | Suzuki | G03G 21/1821 399/111 |
| 2013/0164028 | A1 * | 6/2013 | Morioka | G03G 21/1821 399/111 |
| 2015/0125181 | A1 * | 5/2015 | Oguni | G03G 15/16 399/121 |

FOREIGN PATENT DOCUMENTS

| | | | | |
|---|---|---|---|---|
| JP | 2007-279175 | A | | 10/2007 |
| JP | 2007279175 | A | * | 10/2007 |
| JP | 2010-243771 | A | | 10/2010 |
| JP | 2013-37122 | A | | 2/2013 |
| JP | 2013-148629 | A | | 8/2013 |
| JP | 2015-108724 | A | | 6/2015 |

* cited by examiner

J1
R1
C0
F5
F5a
F5b
21b
21
21a
21e
7
7g
7d
7e
7f
7b
7c
7n
7m
7a
7k
11
11c
10
10f
24
24e
24f
24e1
D0
C5
H1
G1
G2
G3
U1
RS1
FD
Z1
S1
TC1
J2
K1
G
C1
18

CARTRIDGE AND IMAGE FORMING APPARATUS

BACKGROUND OF THE INVENTION

Field of the Invention

The present invention relates to an electrophotographic image forming apparatus (hereinbelow, referred to as an image forming apparatus) and a cartridge detachably attachable to an apparatus main body of the image forming apparatus.

Description of the Related Art

The image forming apparatus described here is to form an image on a recording material using an electrophotographic image forming process. Examples of the image forming apparatus include an electrophotographic copying machine, an electrophotographic printer (such as a laser beam printer and a light-emitting diode (LED) printer), a facsimile device, a word processor, and the like.

The cartridge is obtained by forming at least one of an electrophotographic photosensitive drum (hereinbelow, referred to as a photosensitive drum) as an image bearing member or a process unit (for example, a developer bearing member (hereinbelow, referred to as a developing roller)) acting on the photosensitive drum as a cartridge so as to be detachably attachable to the image forming apparatus.

There are a cartridge in which a photosensitive drum and a developing roller are integrally formed as a cartridge and a cartridge in which a photosensitive drum and a developing roller are separately formed as cartridges. Especially, the former one which includes the photosensitive drum and the developing roller is referred to as a process cartridge. Further, the latter one which includes the photosensitive drum is referred to as a drum cartridge, and the one which includes the developing roller is referred to as a developing cartridge.

The main body of the image forming apparatus is a remaining part of the image forming apparatus except for the cartridge.

Conventionally, image forming apparatuses adopt process cartridge methods in which photosensitive drums and process units acting on the photosensitive drums are integrally formed as cartridges, and the cartridges are formed to be detachably attachable to apparatus main bodies of the image forming apparatuses. According to the process cartridge methods, users can do maintenance of the image forming apparatuses by themselves without asking service persons, so that operability of the apparatuses can be significantly improved. Thus, the process cartridge methods are widely used in the image forming apparatuses.

For example, a developing device configured to be included in the process cartridge generally includes a rotatable charging member for applying charges to the photosensitive drum as a charging unit. A charging roller constituted of an elastic member such as rubber may be used as the charging member. If the elastic member such as rubber used for the roller remains abutting on the photosensitive drum from when it is manufactured to when a user starts using it, the elastic member may be deformed or cause a harmful effect on the photosensitive drum by a material seeping therefrom.

Thus, materials which are less subject to deformation or deterioration are conventionally selected as materials for the elastic member to be used in the process unit. In addition, a configuration is discussed in which a process unit and a photosensitive drum are delivered while maintaining in a separated state so as to expand a range of choices of available materials (Japanese Patent Application Laid-Open No. 2013-148629).

According to the invention described in Japanese Patent Application Laid-Open No. 2013-148629, separation members rotatably disposed on both end portions of a charging roller in an axial direction receive rotational force from the photosensitive drum and move from a first position for separating the photosensitive drum and the charging roller to a second position for abutting the photosensitive drum and the charging roller.

However, according to the configuration described in Japanese Patent Application Laid-Open No. 2013-148629, when the photosensitive drum is rotated, the separation members on the both end portions of the charging roller (the process unit) in the axial direction release a separated state of the charging roller with respect to the photosensitive drum (an image bearing member) at the same time. At that time, urging force is applied to the charging roller in a direction toward the photosensitive drum. When the separation member on the one end portion of the charging roller is rotated to release the separated state of the one end portion, a load is applied to the one end portion of the photosensitive drum in an opposite direction. When the separation member on the other end portion of the charging roller is rotated to release the separated state of the other end portion, a load is also applied to the other end portion of the photosensitive drum in an opposite direction. When these loads are applied at the same time, the load applied to the photosensitive drum opposite to a rotation direction is large.

SUMMARY OF THE INVENTION

An aspect of the present invention is directed to the provision of a cartridge capable of reducing a load to an image bearing member which is applied when a separated state of a process unit with respect to an image bearing member is released in consideration of the above-described situation.

Another aspect of the present invention is directed to the provision of a cartridge including an image bearing member and a rotatable charging roller for charging the image bearing member and capable of moving the charging roller from a first position to a second position closer to the image bearing member than the first position. The cartridge includes a first maintaining member and a second maintaining member, each disposed on respective end portions of the charging roller in an axial direction of the charging roller and configured to maintain a position of the charging roller at the first position, and a first moving portion and a second moving portion, each disposed on respective end portions of the image bearing member in an axial direction of the image bearing member and configured to respectively abut on and move the first maintaining member and the second maintaining member according to a rotation of the image bearing member so as to move the charging roller from the first position to the second position. In a case where the image bearing member is rotated in a state in which the charging roller is in the first position, the first moving portion abuts on the first maintaining member, and then the second moving portion abuts on the second maintaining member.

Further features of the present invention will become apparent from the following description of exemplary embodiments with reference to the attached drawings.

DESCRIPTION OF THE EMBODIMENTS

Various exemplary embodiments, features, and aspects of the present invention will be described in detail below with reference to the attached drawings. Dimensions, materials, and shapes of components described in the exemplary embodiments and their relative positions are to be changed depending on a configuration of an apparatus to which the present invention is applied or various conditions if necessary and thus, if not specifically mentioned, the scope of the present invention is not limited only to such dimensions, materials, and shapes or relative positions.

A cartridge and an image forming apparatus according to the present invention are described with reference to the attached drawings. According to the present exemplary embodiment, a drum cartridge and a developing cartridge are described as examples which are detachably attachable to a main body of the above-described image forming apparatus. In the following description, longitudinal directions of the drum cartridge and the developing cartridge (hereinbelow, simply referred to as a "cartridge" in some cases) are directions approximately parallel to a rotational axis L1 of the photosensitive drum and a rotational axis L9 of the developing roller. Further, the rotational axis L1 of the photosensitive drum and the rotational axis L9 of the developing roller are in a direction intersecting with a conveyance direction of a recording material.

A lateral direction of the cartridge is a direction approximately perpendicular to the rotational axis L1 of the photosensitive drum and the rotational axis L9 of the developing roller. According to the present exemplary embodiment, a direction in which the cartridge is attached to and detached from a main body of a laser beam printer is the lateral direction of each cartridge.

Figure 1:
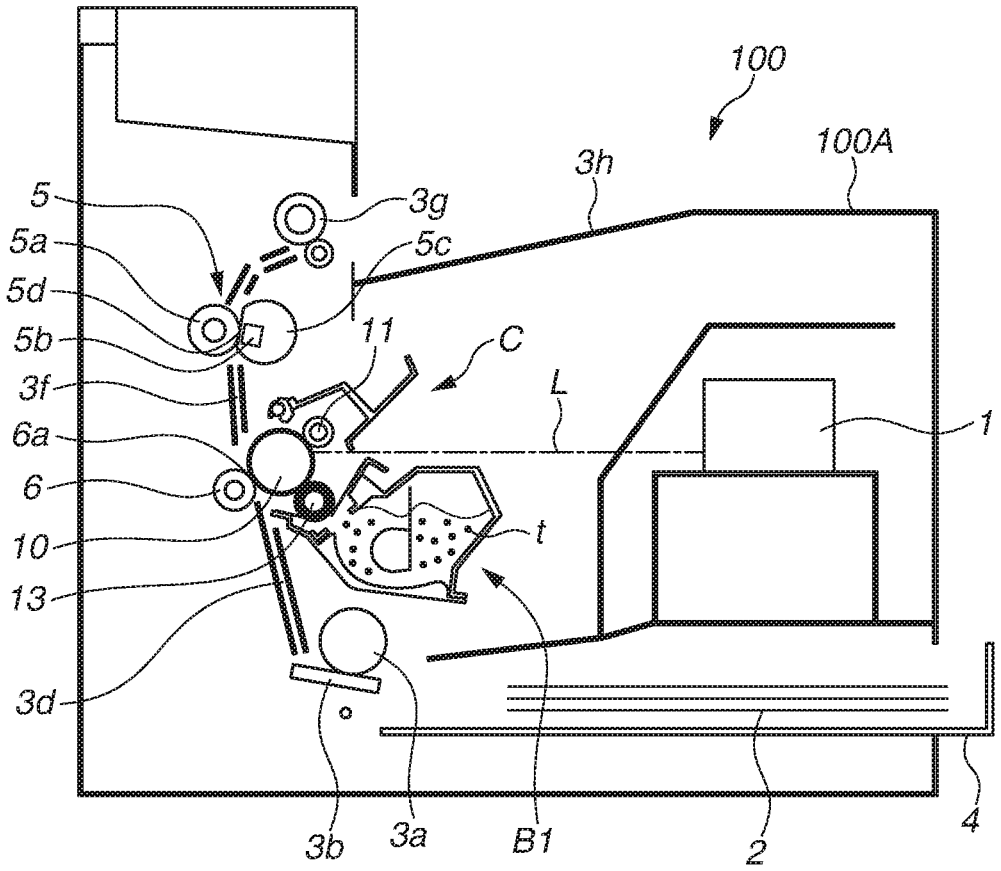
FIG. 1 is a cross-sectional view of an image forming apparatus according to a first exemplary embodiment of the present invention.

FIG. 1 is a cross-sectional view of an image forming apparatus 100 according to a first exemplary embodiment of the present invention. The image forming apparatus 100 forms an image on a recording material 2 by a developer t using an electrophotographic image forming process in response to image information transmitted from an external apparatus such as a personal computer. The image forming apparatus 100 is provided with a developing cartridge B1 and a drum cartridge C which can be attached to and detached from an apparatus main body 100A by a user.

Examples of the recording material 2 include a recording sheet, a label sheet, an overhead projector (OHP) sheet, a cloth, and the like. The developing cartridge B1 includes a developing roller 13 and the like, and the drum cartridge C includes a photosensitive drum 10, a charging roller 11, and the like.

A surface of the photosensitive drum 10 as an "image bearing member" is uniformly charged by the charging roller 11 as a "process unit" by voltage application from the apparatus main body 100A. The charging roller 11 is a roller which is rotatable and mechanically acts on the photosensitive drum 10, which is described below. An optical device 1 irradiates the charged photosensitive drum 10 with a laser beam L corresponding to image information, and an electrostatic image corresponding to the image information is formed on the photosensitive drum 10. The electrostatic image is developed with the developer t by a developing unit described below, and a developer image is formed on the surface of the photosensitive drum 10.

On the other hand, the recording material 2 stored in a sheet feeding tray 4 is regulated by a sheet feeding roller 3*a* and a separation pad 3*b* abutting thereon and separated and fed one by one in synchronization with formation of the developer image. Further, the recording material 2 is conveyed to a transfer roller 6 as a transfer unit by a conveyance guide 3*d*. The transfer roller 6 is urged to come into contact with the surface of the photosensitive drum 10.

Then, the recording material 2 passes through a transfer nip portion 6*a* formed by the photosensitive drum 10 and the transfer roller 6. At that time, a voltage having a polarity opposite to that of the developer image is applied to the transfer roller 6, and thus the developer image formed on the surface of the photosensitive drum 10 is transferred to the recording material 2.

The recording material 2 on which the developer image is transferred is regulated by a conveyance guide 3*f* and conveyed to a fixing device 5. The fixing device 5 includes a drive roller 5*a* and a fixing roller 5*c* having a built-in heater 5*b*. When passing through a nip portion 5*d* formed by the drive roller 5*a* and the fixing roller 5*c*, the recording material 2 is applied with heat and pressure, and thus the developer image transferred to the recording material 2 is fixed to the recording material 2. Accordingly, an image is formed on the recording material 2. Then, the recording material 2 is conveyed by a pair of discharging rollers 3*g* and discharged to a discharge unit 3*h*.

(2) Description of Electrophotographic Image Forming Process

Figure 2:
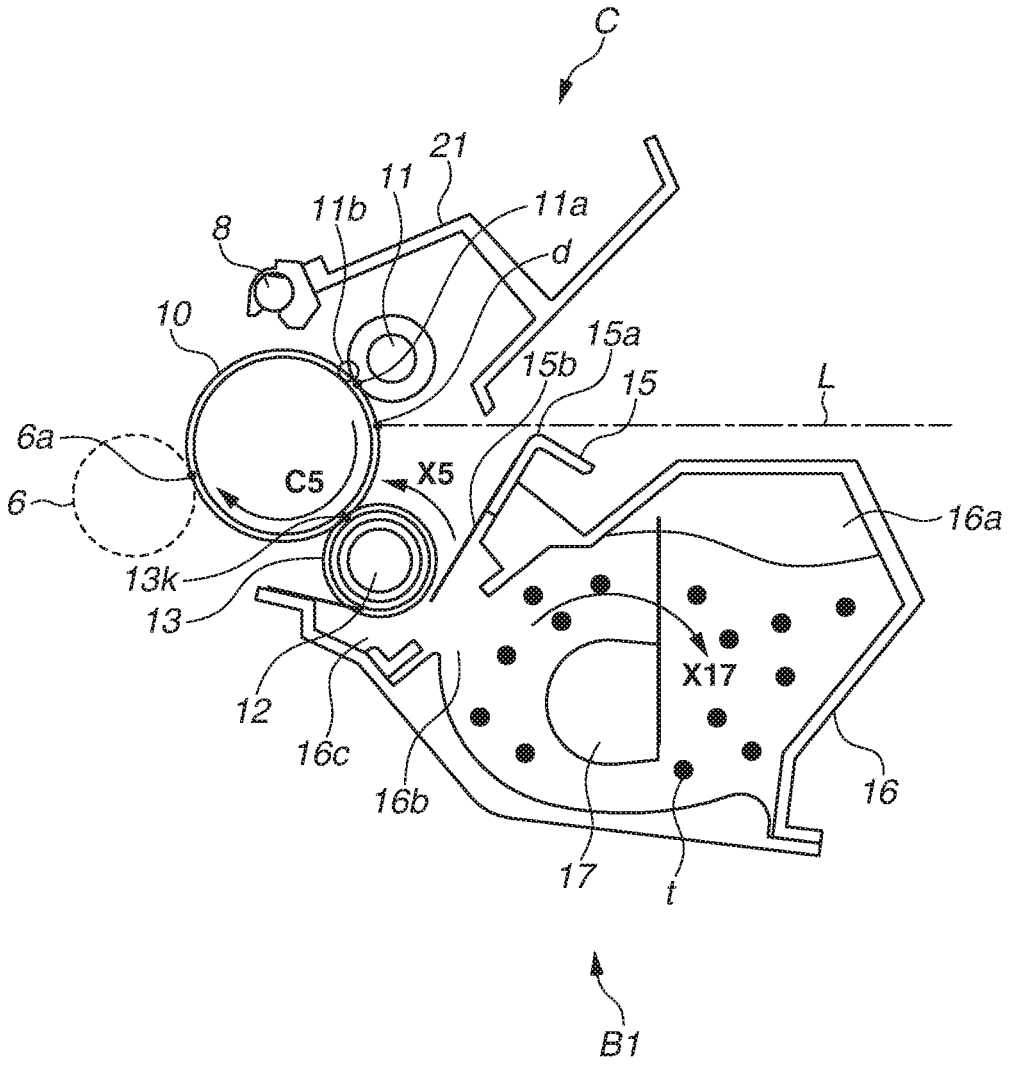
FIG. 2 is a cross-sectional view of a developing cartridge and a drum cartridge.

FIG. 2 is a cross-sectional view of the developing cartridge B1 and the drum cartridge C. With reference to FIG. 2, an electrophotographic image forming process is described to which an exemplary embodiment of the present invention is applied. As illustrated in FIG. 2, the developing cartridge B1 includes a developer container 16, the developing roller 13 as a developing unit, a developing blade 15, and the like. The drum cartridge C includes a cleaning frame 21, the photosensitive drum 10, the charging roller 11, and the like.

The developer t stored in a developer storage unit 16*a* of the developer container 16 is fed from an opening portion 16*b* of the developer container 16 to the inside of a developing chamber 16*c* by rotation of a conveyance member 17 rotatably supported by the developer container 16 in a direction of an arrow X17. The developer container 16 is provided with the developing roller 13 with a built-in magnet roller 12. More specifically, the developing roller 13 is constituted of a shaft portion 13*e* and a rubber portion 13*d* (see FIGS. 5A and 5B). The shaft portion 13*e* has a slender cylindrical shape made of a conductive material, such as aluminum, and a center portion in the longitudinal direction thereof is covered with the rubber portion 13*d* (see FIGS. 5A and 5B).

The rubber portion 13*d* covers the shaft portion 13*e* so that an outer shape thereof and the shaft portion 13*e* are on a coaxial line. The developing roller 13 pulls the developer t in the developing chamber 16*c* to a surface of the developing roller 13 by magnetic force of the magnet roller 12. The developing blade 15 is constituted of a support member 15*a* formed by a sheet metal and an elastic member 15*b* formed by urethane rubber, a stainless steel (SUS) plate, and the like, and the elastic member 15*b* is arranged so as to elastically contact the developing roller 13 at a constant contact pressure.

When the developing roller 13 is rotated in a rotation direction X5, an amount of the developer t adhering to the surface of the developing roller 13 is regulated, and a triboelectric charge is applied to the developer t. Accordingly, a developer layer is formed on the surface of the developing roller 13. Then, the developing roller 13 to which a voltage is applied from the apparatus main body 100A is rotated in the rotation direction X5 in a state in which the developing roller 13 is in contact with the photosensitive drum 10, and thus the developer t is supplied to a developing area of the photosensitive drum 10.

On an outer circumferential surface of the photosensitive drum 10, the charging roller 11 is disposed so as to be in contact therewith. The charging roller 11 is rotatably supported by the cleaning frame 21 and urged in a direction toward the photosensitive drum 10. The configuration is described in detail below. The charging roller 11 uniformly charges the surface of the photosensitive drum 10 by the voltage application from the apparatus main body 100A. The voltage applied to the charging roller 11 is set to a value which makes a potential difference between the surface of the photosensitive drum 10 and the charging roller 11 a discharge starting voltage or larger, more specifically, a direct current (DC) voltage of −1300 V is applied as a charging bias.

At that time, the surface of the photosensitive drum 10 is uniformly charged to a charging potential (a dark portion potential) −700 V by contact charge. According to the present exemplary embodiment, the charging roller 11 is driven to rotate with respect to the rotation of the photosensitive drum 10 (which is described in detail below). Further, an electrostatic image is formed on the surface of the photosensitive drum 10 by the laser beam L from the optical device 1. Then, the electrostatic image is visualized by transferring the developer t according to the electrostatic image on the photosensitive drum 10, and the developer image is formed on the photosensitive drum 10.

(3) Description of Configuration of Cleanerless System

Next, a cleanerless system according to the present exemplary embodiment is described below. According to the present exemplary embodiment, an example of the cleanerless system is described which does not include a cleaning member for removing a transfer residual developer remaining on the photosensitive drum 10 without being transferred from the surface of the photosensitive drum 10.

The photosensitive drum 10 is driven to rotate in a direction of an arrow C5 as illustrated in FIG. 2. The transfer residual developer remaining on the surface of the photosensitive drum 10 after a transfer process is charged to a negative polarity similar to the photosensitive drum 10 by discharging in an upstream void portion 11*b*. The void portion 11*b* is a void portion on an upstream side of a charging nip portion 11*a* which is an abutment portion of the charging roller 11 and the photosensitive drum 10. At that time, the surface of the photosensitive drum 10 is charged to −700 V. The transfer residual developer charged to the negative polarity passes through the charging nip portion 11*a* without adhering to the charging roller 11 because of a relationship of a potential difference (a surface potential of the photosensitive drum 10=−700 V, and a potential of the charging roller 11=−1300 V).

The transfer residual developer passing through the charging nip portion 11*a* reaches a laser irradiation position d. An amount of the transfer residual developer is not enough to block the laser beam L of an optical unit and does not affect a process for forming an electrostatic image on the photosensitive drum 10. The transfer residual developer on a non-exposed portion (the surface of the photosensitive drum 10 where is not irradiated with the laser) in the transfer residual developer passing through the laser irradiation position d is collected by the developing roller 13 by electrostatic force at a develop nip portion 13*k* which is an abutment portion of the developing roller 13 and the photosensitive drum 10.

On the other hand, the transfer residual developer on an exposed portion (the surface of the photosensitive drum 10 where is irradiated with the laser) continues to exist on the photosensitive drum 10 as it is without being collected by electrostatic force. However, a portion of the transfer residual developer may be collected by physical force caused by a circumferential speed difference between the developing roller 13 and the photosensitive drum 10.

As described above, the transfer residual developer remaining on the photosensitive drum 10 without being transferred to the sheet is mostly collected to the developer container 16. The transfer residual developer collected to the developer container 16 is mixed with the developer t remaining in the developer container 16 and used.

According to the present exemplary embodiment, following two configurations are adopted so as to cause the transfer residual developer to pass through the charging nip portion 11*a* without adhering to the charging roller 11. First, an optical discharge member 8 is disposed between the transfer roller 6 and the charging roller 11. The optical discharge member 8 is placed on an upstream side of the charging nip portion 11*a* in a rotation direction (the direction of the arrow C5) of the photosensitive drum 10.

In addition, the surface potential of the photosensitive drum 10 after passing through the transfer nip portion 6*a* is optically discharged so as to stably perform discharge at the upstream void portion 11*b*. Since the potential of the photosensitive drum 10 before charging is set to be about −150 V in an entire area in the longitudinal direction by the optical discharge member 8, discharge can be uniformly performed in charging, and the transfer residual developer can uniformly have the negative polarity.

Second, the charging roller 11 is driven to rotate while being set a predetermined circumferential speed difference with respect to the photosensitive drum 10. As described above, the toner mostly has the negative polarity by discharge, but the transfer residual developer which cannot have the negative polarity somewhat remains, and the remaining transfer residual developer may adhere to the charging roller 11 at the charging nip portion 11*a*. When the charging roller 11 and the photosensitive drum 10 are driven to rotate with the predetermined circumferential speed difference, the such transfer residual developer can have the negative polarity by a rub between the photosensitive drum 10 and the charging roller 11.

Accordingly, an effect of suppressing adhesion of the transfer residual developer to the charging roller 11 can be provided. According to the present exemplary embodiment, a charging roller gear 69 (in FIG. 7, described in detail below) is disposed on one end of the charging roller 11 in the longitudinal direction, and the charging roller gear 69 is engaged with a drive side flange 24 (in FIG. 7, described in detail below) disposed on one end of the photosensitive drum 10 in the same longitudinal direction. Thus, together with the rotation of the photosensitive drum 10, the charging roller 11 is also rotated. A circumferential speed of a surface of the charging roller 11 is set to be 100 to 150% with respect to a circumferential speed of the surface of the photosensitive drum 10.

(4) Description of Configuration of Developing Cartridge B1

<Overall Configuration of Developing Cartridge B1>

Next, a configuration of the developing cartridge B1 to which the exemplary embodiment of the present invention is applied is described with reference to the attached drawings. In the following description, a side to which rotational force is transmitted from the apparatus main body 100A to the developing cartridge B1 regarding the longitudinal direction is referred to as a "drive side". Further, an opposite side thereof is referred to as a "non-drive side".

Figure 3:
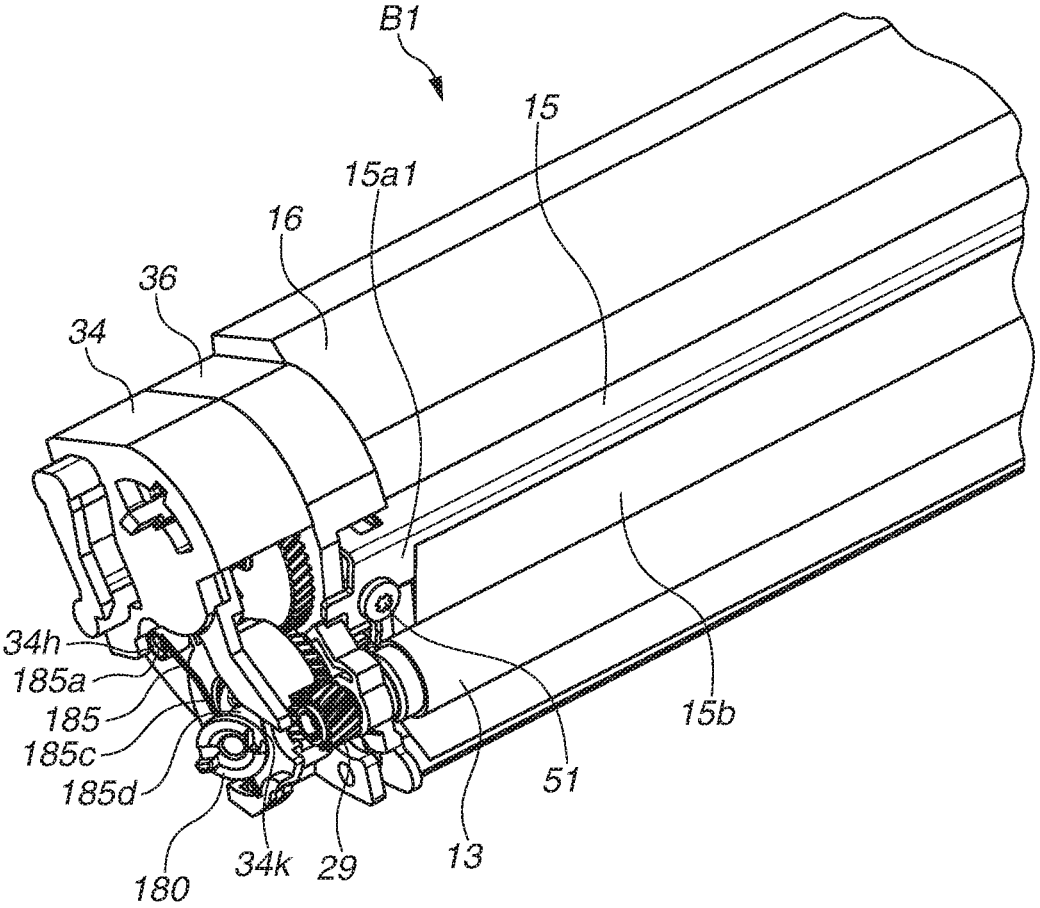
FIG. 3 is a perspective view of the developing cartridge viewed from a drive side.
Figure 4:
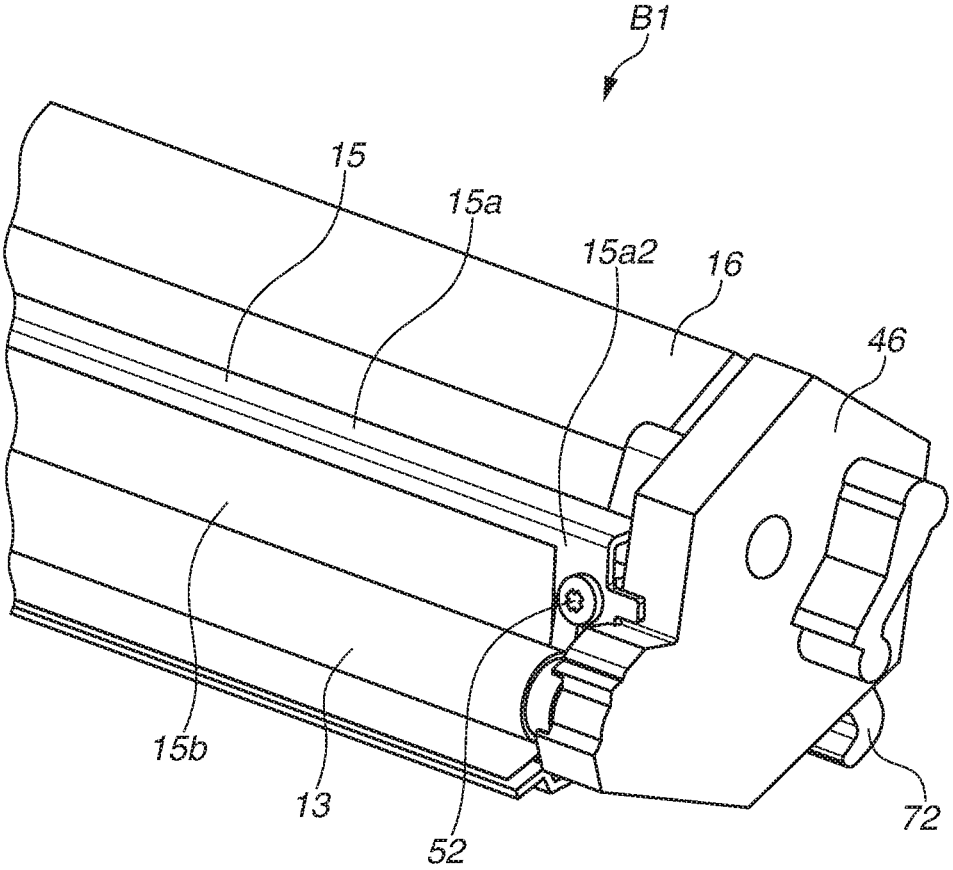
FIG. 4 is a perspective view of the developing cartridge viewed from a non-drive side.
Figure 5A:
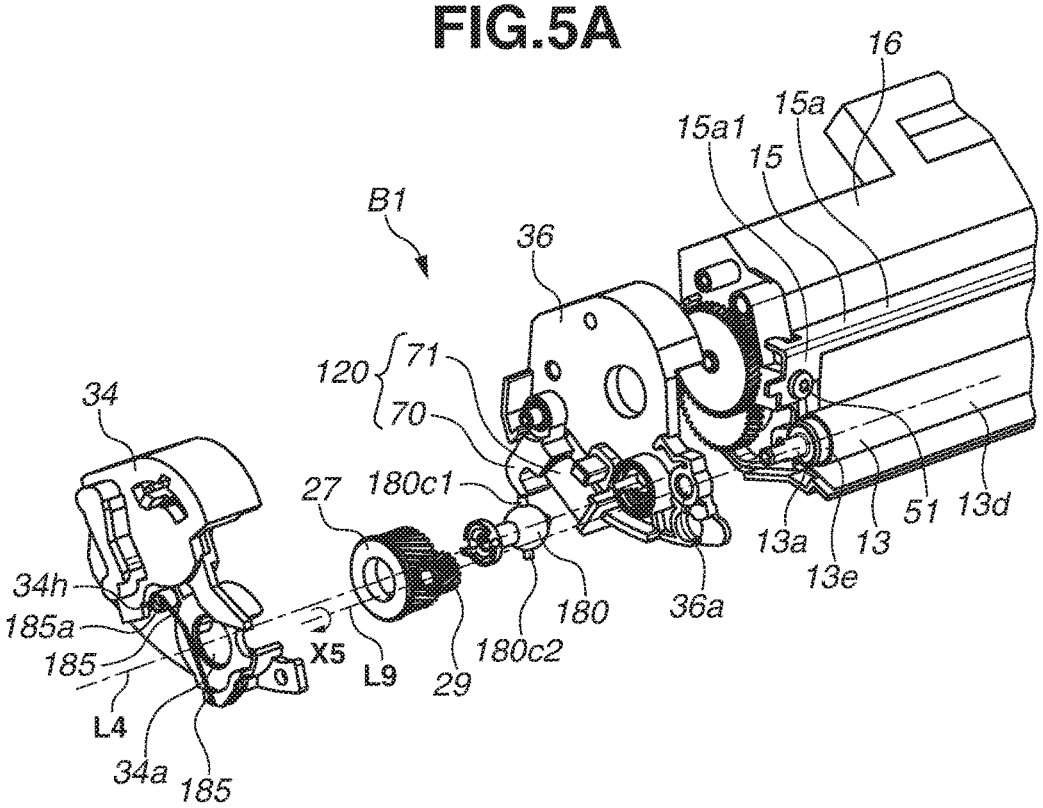
FIGS. 5A and 5B are exploded perspective views of the drive side of the developing cartridge respectively viewed from the drive side and the non-drive side.
Figure 5B:
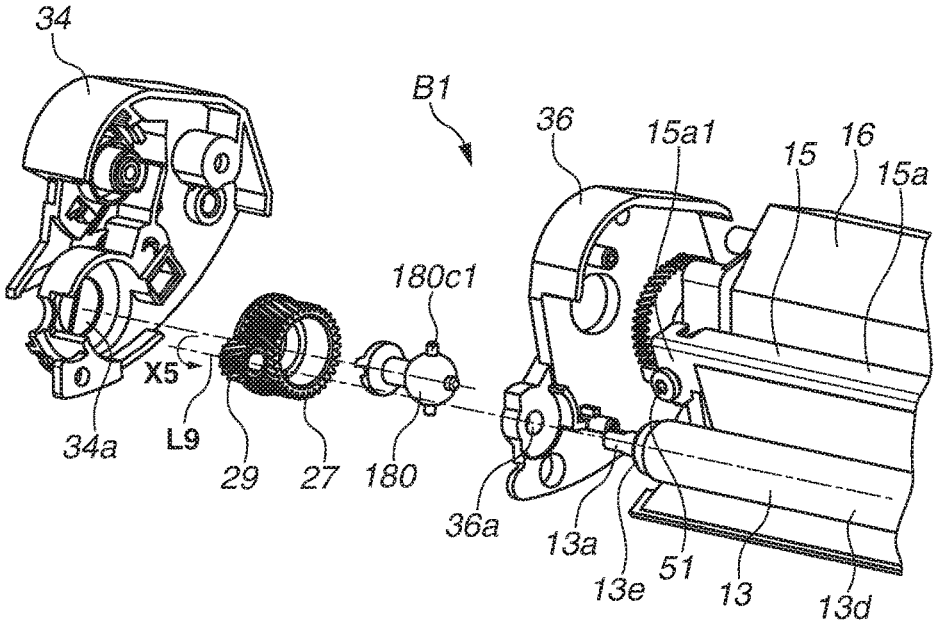
Figure 6A:
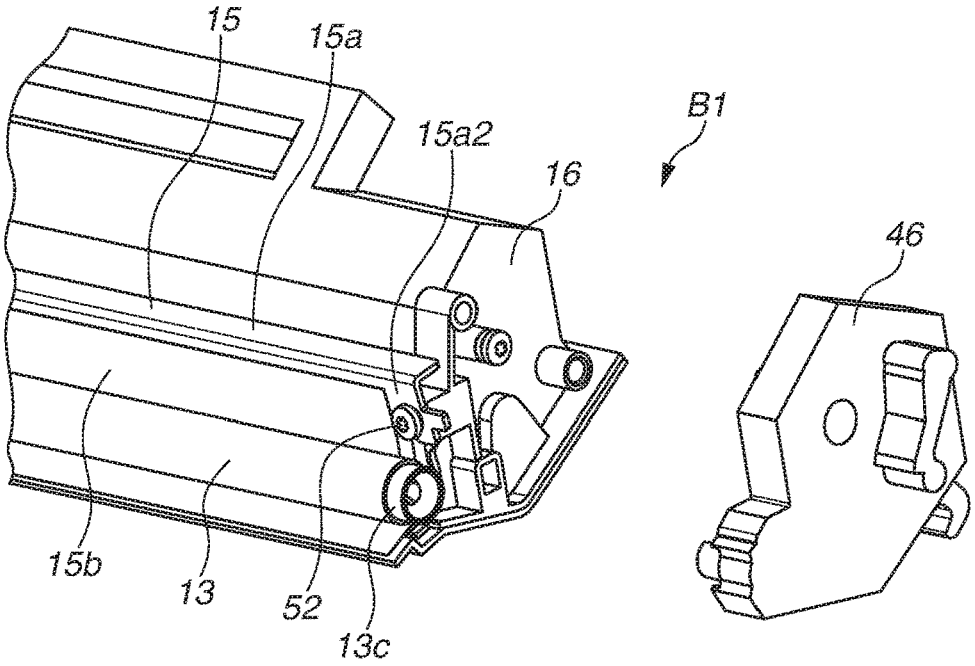
FIGS. 6A and 6B are exploded perspective views of the non-drive side of the developing cartridge respectively viewed from the non-drive side and the drive side.
Figure 6B:
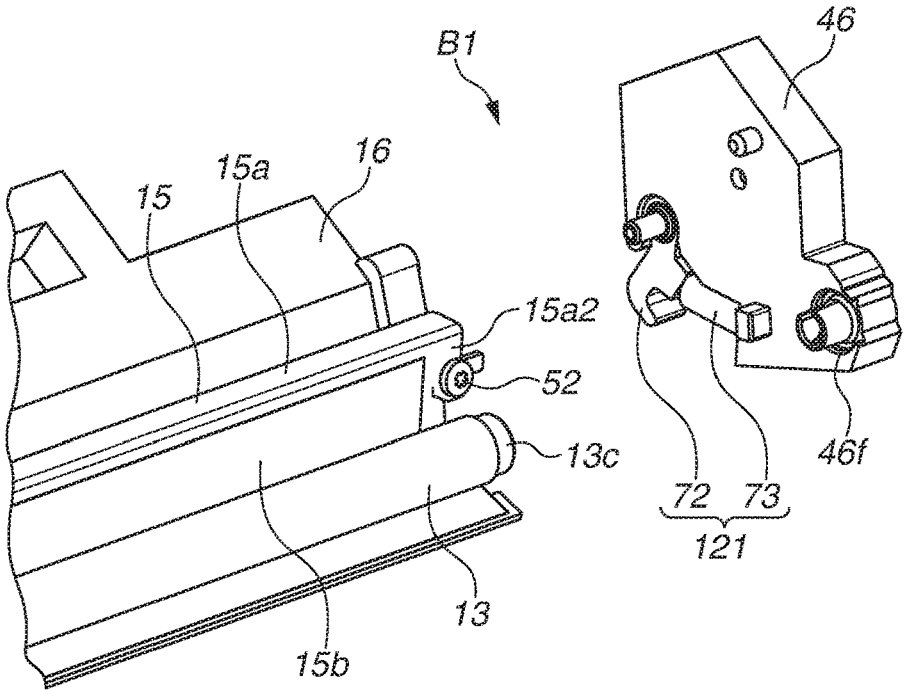

FIG. 3 is a perspective view of the developing cartridge B1 viewed from the drive side. FIG. 4 is a perspective view of the developing cartridge B1 viewed from the non-drive side. FIGS. 5A and 5B are exploded perspective views of the drive side of the developing cartridge B1, FIG. 5A is a perspective view from the drive side, and FIG. 5B is a perspective view from the non-drive side. FIGS. 6A and 6B are exploded perspective views of the no-drive side of the developing cartridge B1, FIG. 6A is a perspective view from the non-drive side, and FIG. 6B is a perspective view from the drive side.

As illustrated in FIGS. 5A, 5B, 6A, and 6B, the developing cartridge B1 includes the developing roller 13, the developing blade 15, and the like. The developing blade 15 is fixed to the developer container 16 at a drive side end portion 15*a*1 and a non-drive side end portion 15*a*2 of the support member 15*a* in the longitudinal direction with screws 51 and 52. On the both ends of the developer container 16 in the longitudinal direction, a drive side developing bearing 36 and a non-drive side bearing 46 are respectively disposed.

A drive side end portion 13*a* is engaged with a hole 36*a* of the drive side developing bearing 36, and a non-drive side end portion 13*c* is engaged with a support portion 46*f* of the non-drive side bearing 46, so that the developing roller 13 is supported to be able to rotate. On the drive side end portion 13*a* of the developing roller 13, a developing roller gear 29 is disposed coaxially with the developing roller 13 in the longitudinal direction on an outer side than the drive side developing bearing 36, and the developing roller 13 and the developing roller gear 29 engage with each other so as to be able to integrally rotate (see FIG. 3).

The drive side developing bearing 36 rotatably supports a drive input gear 27 on the outer side in the longitudinal direction. The drive input gear 27 is engaged with the developing roller gear 29. Further, a coupling member 180 is provided on the same axis of the drive input gear 27.

On a drive side endmost portion of the developing cartridge B1, a developing side cover 34 is disposed to cover the drive input gear 27 and the like from the outside in the longitudinal direction. The coupling member 180 protrudes the outside in the longitudinal direction through a hole 34*a* of the developing side cover 34. The coupling member 180 is configured to transmit rotational force by engaging with a main body side drive member, not illustrated, disposed on the apparatus main body 100A.

The rotational force is transmitted to the drive input gear 27 via rotational force transmission portions 180*c*1 and 180*c*2 of the coupling member 180. Accordingly, the rotational force input to the coupling member 180 is transmitted to the developing roller 13 as a rotation member via the drive input gear 27 and the developing roller gear 29.

The drive side developing bearing 36 is provided with a first movable member 120. The first movable member 120 includes a drive side abutment and separation lever 70 as a first main body unit and a drive side developing pressurization spring 71 as a first elastic unit. The non-drive side bearing 46 is provided with a second movable member 121. The second movable member 121 includes a non-drive side abutment and separation lever 72 as a second main body unit and a non-drive side developing pressurization spring 73 as a second elastic unit. Details of these components are described below.

(5) Brief Description of Drum Cartridge C

<Overall Configuration of Drum Cartridge C>

Figure 7:
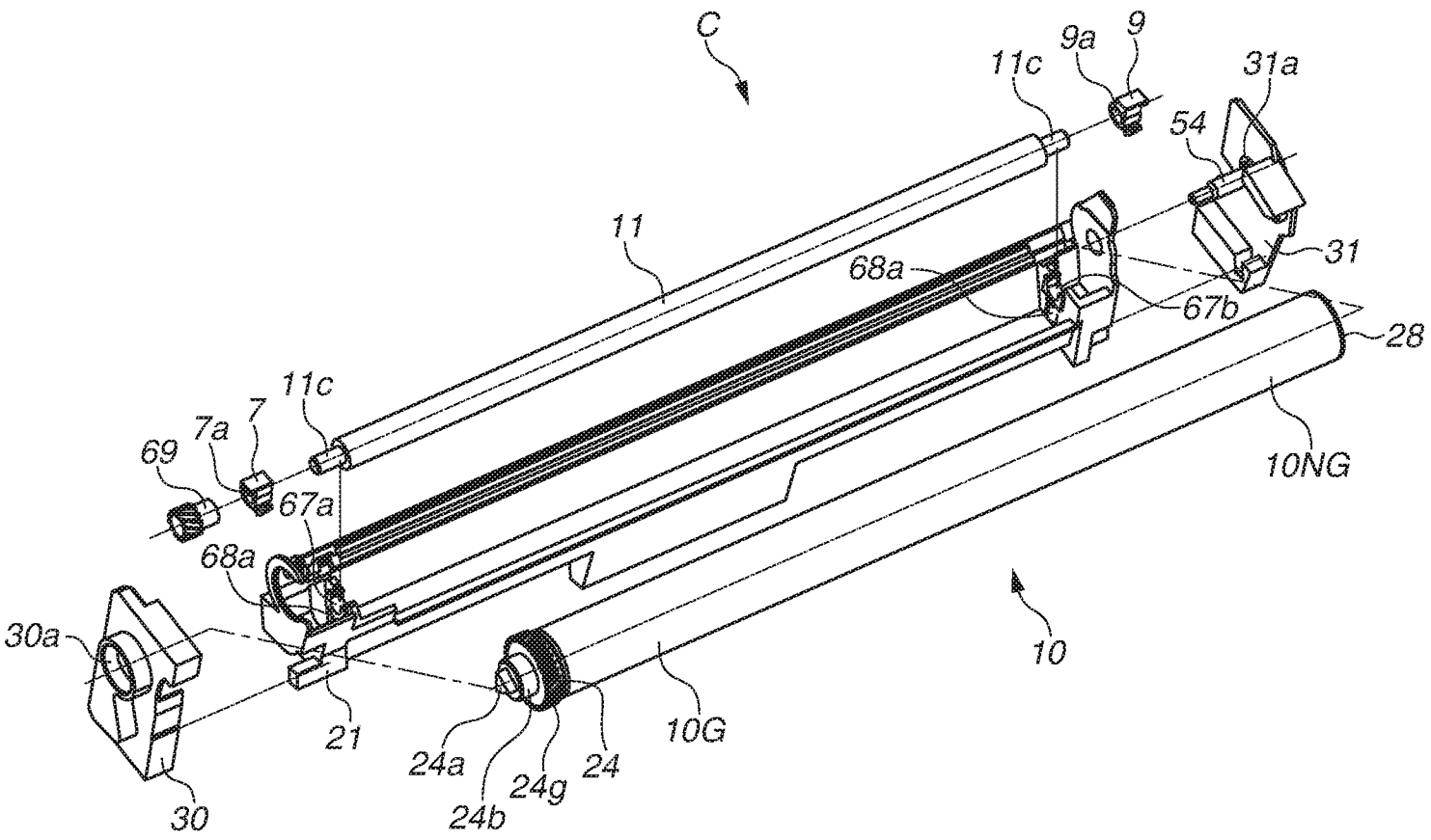
FIG. 7 illustrates installation of a photosensitive drum and a charging roller to a cleaning frame.

FIG. 7 illustrates installation of the photosensitive drum 10 and the charging roller 11 to the cleaning frame 21. The photosensitive drum 10 is supported by the cleaning frame 21. On a non-drive side 10NG of the photosensitive drum 10, a borne portion 28*f* of the non-drive side flange 28 (see FIG. 8C) is rotatably supported by a drum shaft 54. The drum shaft 54 is pressed into and fixed by a support portion 31*a* of a non-drive side bearing 31 as a support member provided on the non-drive side of the cleaning frame 21. The non-drive side bearing 31 and the cleaning frame 21 are fixed by a screw, a melted resin, adhesive, and the like (not illustrated).

On the other hand, on a drive side 10G of the photosensitive drum 10, a borne portion 24*b* of the drive side flange 24 is rotatably supported by a bearing portion 30*a* of a drive side bearing 30 as a support member. The drive side bearing 30 and the cleaning frame 21 are fixed by a screw, a melted resin, adhesive, and the like (not illustrated).

Figure 10:
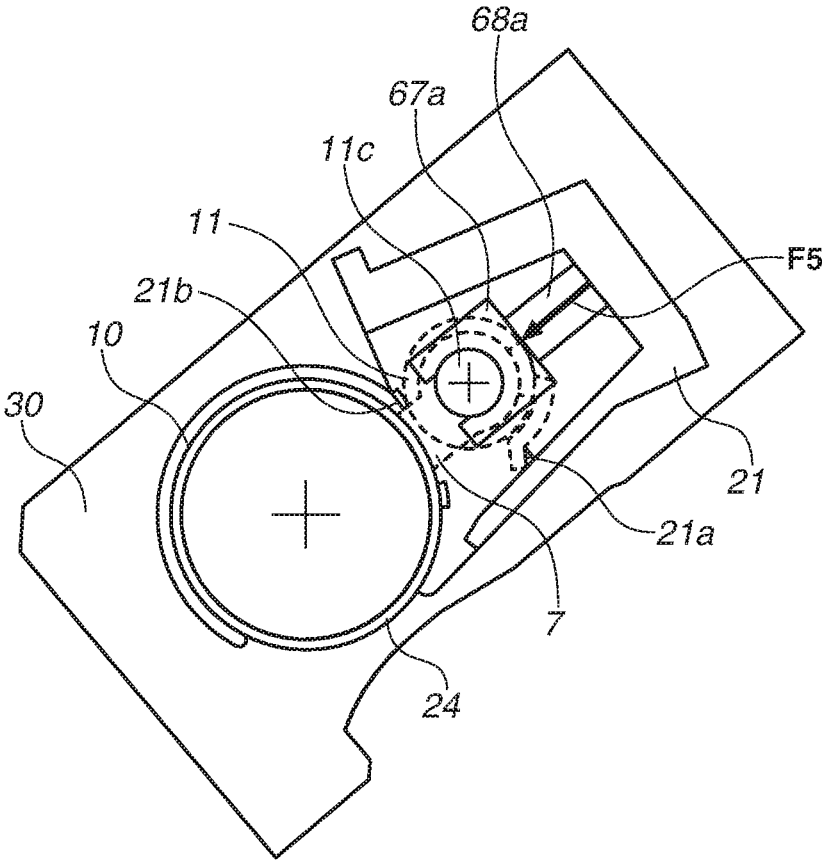
FIG. 10 is a cross-sectional view of the photosensitive drum and the charging roller viewed from a bearing side of the drive side.

As illustrated in FIG. 7 and FIG. 10, the charging roller 11 is rotatably supported by a charging roller bearing 67*a* and a charging roller bearing 67*b* and urged to the photosensitive drum 10 by two urging members 68*a*. As illustrated in FIG. 7, regarding an axial direction of the charging roller 11 (the longitudinal direction of the charging roller 11), the charging roller bearing 67*a* and one end of the urging member 68*a* are disposed on one end side and the charging roller bearing 67*b* and the other end of the urging member 68*a* are disposed on the other end side of the charging roller 11.

As illustrated in FIG. 7, a first separation member 7 as a first released member is disposed on the drive side end portion of the charging roller 11. The first separation member 7 is rotatably supported by engaging an annular portion 7*a* with a core metal 11*c* of the charging roller 11. Further, a second separation member 9 as a second released member is disposed on the non-drive side end portion of the charging roller 11. The second separation member 9 is rotatably supported by engaging an annular portion 9*a* with the core metal 11*c* of the charging roller 11 (operations of the first separation member 7 and the second separation member 9 are described below).

The charging roller gear 69 is disposed on the drive side end portion of the charging roller 11 and engages with a gear portion 24*g* of the drive side flange 24. Rotational force is transmitted to a drive side end portion 24*a* of the drive side flange 24 from the apparatus main body 100A (not illustrated) side, and the photosensitive drum 10 is rotated at the same time. As a result, together with the rotation of the photosensitive drum 10, the charging roller 11 is also rotated. As described above, the circumferential speed of the surface of the charging roller 11 is set to be 100 to 150% with respect to the circumferential speed of the surface of the photosensitive drum 10.

According to the present exemplary embodiment, the cleaning frame 21, the non-drive side bearing 31, and the drive side bearing 30 are formed as separated bodies and fixed. However, the cleaning frame 21, the non-drive side bearing 31, and the drive side bearing 30 may be integrally formed.

<Configuration of Photosensitive Drum>

Figure 8A:
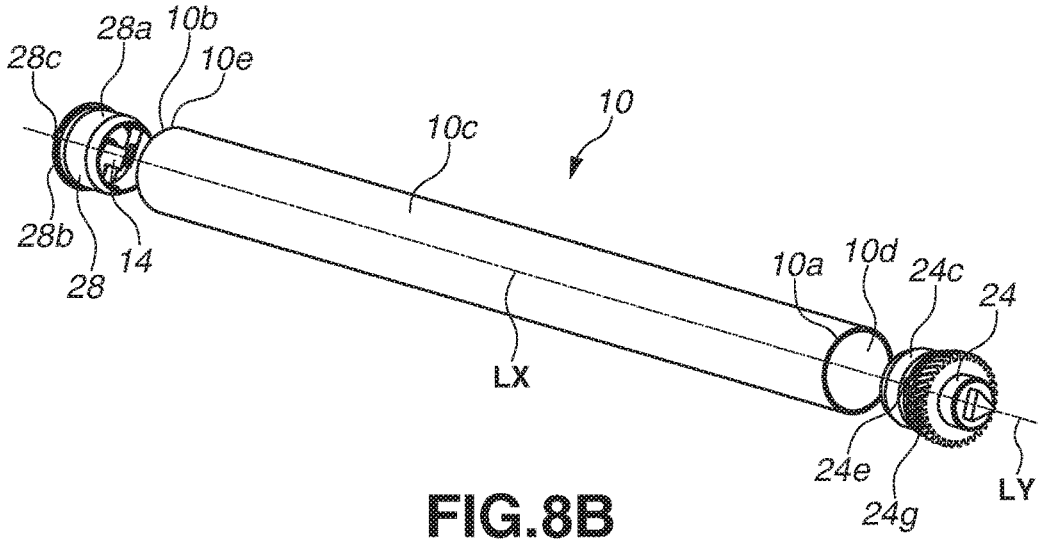
FIGS. 8A to 8C illustrate configurations of the photosensitive drum.
Figure 8B:
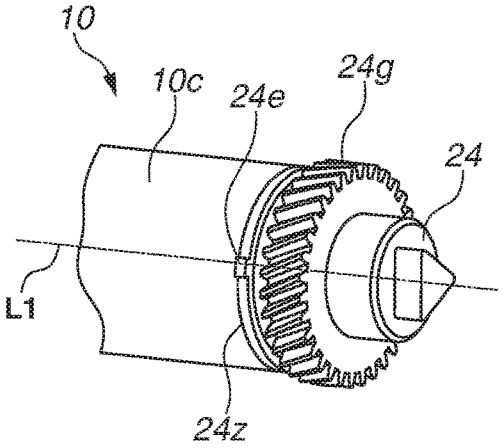
Figure 8C:
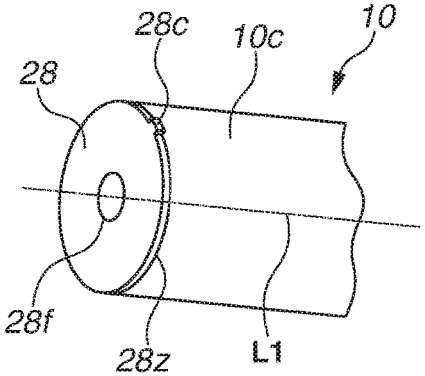

A configuration of the photosensitive drum 10 is described with reference to FIGS. 8A to 8C. FIGS. 8A to 8C are configuration diagrams of the photosensitive drum 10. FIG. 8A is an exploded perspective view thereof. FIG. 8B is a partial perspective view from the drive side. FIG. 8C is a partial perspective view from the non-drive side.

As illustrated in FIG. 8A, the photosensitive drum 10 includes a photosensitive member 10*c*, the drive side flange 24, the non-drive side flange 28, and a ground plate 14. The photosensitive member 10*c* is a conductive member, such as aluminum, which is coated with a photosensitive layer on its surface. The inside of the photosensitive member 10*c* may be hollow or solid.

The drive side flange 24 is disposed on a drive side end portion 10*a* of the photosensitive member 10*c*. More specifically, a fixed portion 24*c* engages with an opening portion 10*d* of the drive side end portion 10*a* of the photosensitive member 10*c*, and thus the drive side flange 24 is fixed to the photosensitive member 10*c* by adhesion, caulking, and the like (see FIG. 8B). When the drive side flange 24 is rotated, the photosensitive member 10*c* is integrally rotated. In this regard, the drive side flange 24 is fixed to the photosensitive member 10*c* in such a manner that a rotational axis LY as a flange axis line of the drive side flange 24 becomes substantially coaxial (on the same line) with an axis line LX of the photosensitive member 10*c*.

The expression "substantially coaxial (on the same line)" includes a case in which axes are completely consistent coaxial (on the same line) and also a case in which the axes are slightly shifted from a coaxial state (on the same line) because of variation in dimensions of components. The same manner is applied to the following description.

Similarly, as illustrated in FIG. 8A, the non-drive side flange 28 is substantially coaxial with the axis of the photosensitive member 10*c* and disposed on a non-drive side end portion 10*b* of the photosensitive member 10*c*. A fixed portion 28*a* of the non-drive side flange 28 is fixed to the photosensitive member 10*c* at an opening portion 10*e* of the non-drive side end portion 10*b* of the photosensitive member 10*c* by adhesion, caulking, and the like (see FIG. 8C). In addition, a conductive (mainly metal) ground plate 14 is disposed on the non-drive side flange 28. The ground plate 14 is in contact with an inner circumferential surface of the photosensitive member 10*c* and electrically connected to the apparatus main body 100A (not illustrated).

As illustrated in FIG. 8B, a first releasing portion 24*e* having a convex shape protruding from the surface of the photosensitive member 10*c* is provided on an abutment surface 24*z* of the drive side flange 24 with respect to the photosensitive member 10*c* in the longitudinal direction.

Similarly, as illustrated in FIG. 8C, a second releasing portion 28*c* having a convex shape protruding from the surface of the photosensitive member 10*c* is provided on an abutment surface 28*z* of the non-drive side flange 28 with respect to the photosensitive member 10*c* in the longitudinal direction.

(6) Separated State and Separation Release Operation of Process Unit (Separated State and Separation Release Operation)

Figures 9A, 9B, 9C, 9D, 9E:
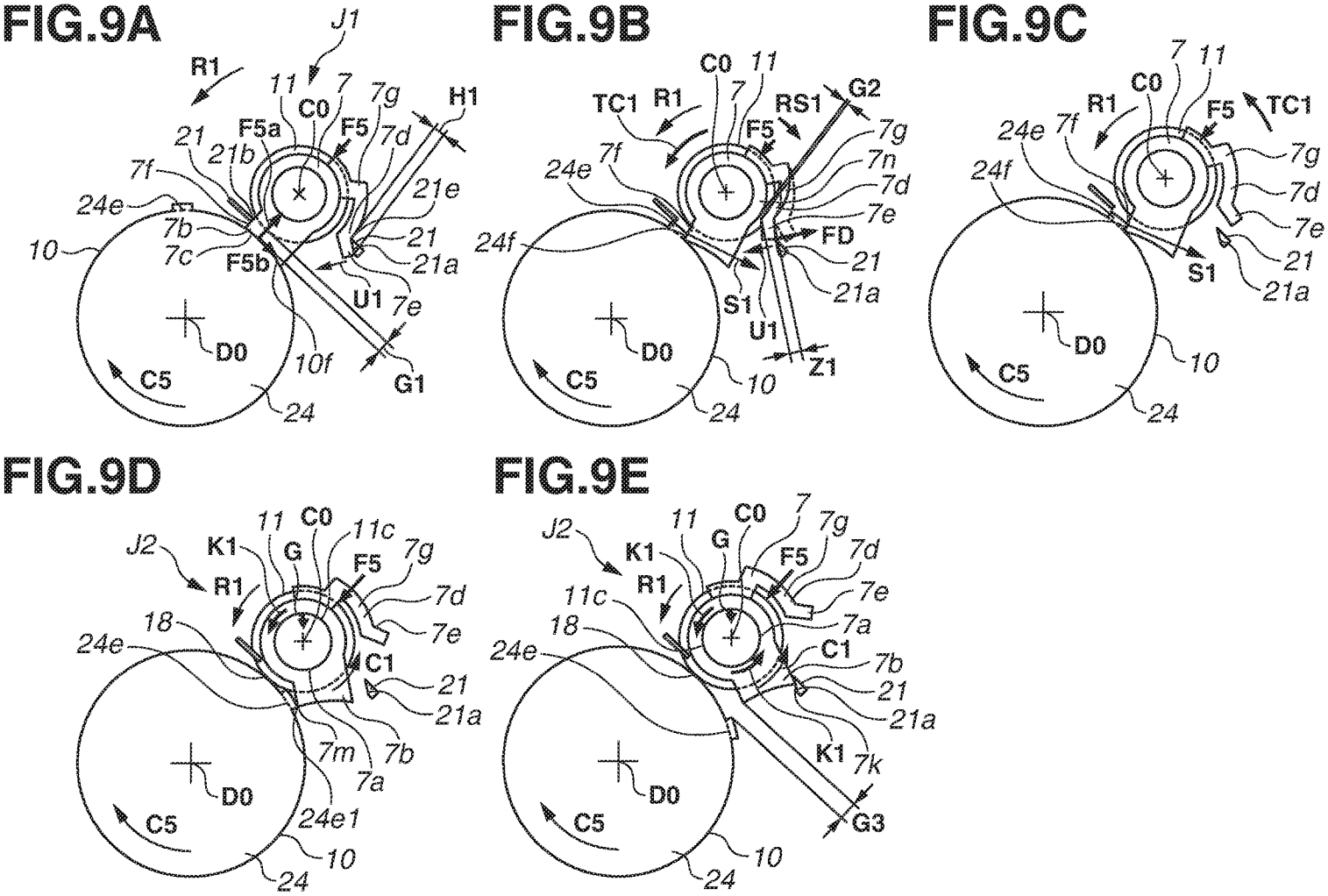
FIGS. 9A to 9E are side views illustrating operations from a state in which a first separation member disposed on the drive side separates the charging roller from the photosensitive drum to a state in which the charging roller and the photosensitive drum abut on each other by being released from a separated state by the first separation member, and rotation of the first separation member is complete.

A separation release operation of the charging roller 11 is described with reference to FIGS. 9A to 9E. FIGS. 9A to 9E are side views illustrating operations from a state in which the first separation member 7 disposed on the drive side separates the charging roller 11 from the photosensitive drum 10 (FIG. 9A) to a state in which the charging roller 11 and the photosensitive drum 10 abut on each other by being released from the separated state by the first separation member 7, and rotation of the first separation member 7 is complete (FIG. 9D). Components are not illustrated except for parts of the photosensitive drum 10, the charging roller 11, the first releasing portion 24*e*, the first separation member 7, and the cleaning frame 21 for ease of the description.

In addition, operations of the second separation member 9 disposed on the non-drive side are similar to those of the first separation member 7 disposed on the drive side, and thus description of the operations of the second separation member 9 is omitted. FIG. 9A illustrates a state of the drum cartridge C during distribution from when the drum cartridge C is manufactured to when a user starts to use the drum cartridge C or storage. The first separation member 7 is in a phase at which an abutment surface 7*c* of an abutment portion 7*b* abuts on an abutment portion 10*f* of the photosensitive drum 10. Accordingly, the charging roller 11 is separated from the photosensitive member 10*c* by a distance G1 (a first position). In other words, the first separation member 7 and the second separation member 9 are respectively a first maintaining member and a second maintaining member for maintaining the photosensitive member 10*c* and the charging roller 11 in a separated state.

The charging roller 11 is urged in the direction toward the photosensitive drum 10 by urging force F5 applied by the urging member 68*a* (see FIG. 10). Thus, the abutment surface 7*c* of the first separation member 7 receives normal force F5*a* from the photosensitive drum 10.

At that time, a convex shape portion 7*e* on a phase determined portion 7*d* disposed on a tip end of an arm portion 7*g* which is elastically deformable in a direction of an arrow U1 of the first separation member 7 is in contact with a surface 21*a* provided on the cleaning frame 21 (in detail, see FIG. 10). Thus, when the photosensitive drum 10 is moved in the direction of the arrow C5, frictional force F5*b* acts on the first separation member 7 due to the normal force F5*a*.

According to the present exemplary embodiment, magnitude of the frictional force F5*b* generated when the photosensitive drum 10 is moved in the direction of the arrow C5 by the distribution is smaller than a force necessary for the first separation member 7 to rotate and the phase determined portion 7*d* (the arm portion) to deform in the direction of the arrow U1 and overcome the surface 21*a*. Therefore, during the distribution, the first separation member 7 does not rotate about a rotation center C0 of the charging roller 11 in a direction of an arrow R1.

In addition, a surface 21*b* (a second regulation surface) on the cleaning frame 21 (in detail, see FIG. 10) is in contact with a surface 7*f* of the abutment portion 7*b* of the first separation member 7 on an upstream side in the rotation direction (the direction of the arrow R1) of the first separation member 7. Accordingly, the first separation member 7 is regulated to rotate about the rotation center C0 of the charging roller 11 in a direction opposite to the direction of the arrow R1.

As described above, if the drum cartridge C receives a large impact in this state during the distribution or the storage, a position of the first separation member 7 is determined by the surface 21*a* and the surface 21*b*, and the separated state between the charging roller 11 and the photosensitive drum 10 can be maintained.

Next, a process until the separated state is released is described. The drum cartridge C is configured so that the charging roller 11 can move between a first position J1 at which the charging roller 11 is separated from the photosensitive drum 10 and a second position J2 at which the charging roller 11 approaches the photosensitive drum 10.

FIG. 9B illustrates a state when use of the drum cartridge C is started and immediately before the arm portion 7*g* of the first separation member 7 overcomes the surface 21*a* provided on the cleaning frame 21. At that time, there is a gap of a distance G2 at a closest portion between the phase determined portion 7*d* and an annular portion 7*n* of the first separation member 7.

When a user starts to use the drum cartridge C, the photosensitive drum 10 receives driving force from a drive source (not illustrated) of the apparatus main body 100A and is rotated about a rotation center D0 in the direction of the arrow C5. At that time, the surface 7*f* of the first separation member 7 on the upstream side in the rotation direction (the direction of the arrow R1) of the first separation member 7 receives force in a direction of an arrow S1 from a surface 24*f* (a first moving portion) of the first releasing portion 24*e* disposed on the photosensitive drum 10 on a downstream side in the rotation direction (the direction of the arrow C5) of the photosensitive drum 10. Accordingly, torque TC1 acts on the first separation member 7 around the rotation center C0 of the charging roller 11.

When the torque TC1 around the rotation center C0 of the charging roller 11 acts on the first separation member 7, the elastically deformable arm portion 7*g* is bent by a deformation amount Z1. At that time, torque RS1 acts on the first separation member 7 in a direction opposite to the direction of the arrow R1 due to elastic force FD acting on the surface 21*a* from the arm portion 7*g* caused by bending of the arm portion 7*g*.

A height H1 of a portion where the convex shape portion 7*e* overlaps with the surface 21*a* in the rotation direction (the direction of the arrow R1) of the first separation member 7 can be appropriately set according to magnitude of vibration caused by the distribution, deflection force when the arm portion 7*g* is bent in the direction of the arrow U1, and rotational force received from the photosensitive drum 10. According to the present exemplary embodiment, the force necessary for the arm portion 7*g* to overcome the surface 21*a* is set smaller than force that the photosensitive drum 10 is rotated the first separation member 7 in the direction of the arrow R1.

In other words, the torque TC1 acting on the first separation member 7 from the first releasing portion 24*e* is larger than the torque RS1 generated due to the bending of the arm portion 7*g* of the first separation member 7. Accordingly, the first separation member 7 is rotated by the first releasing portion 24*e* about the rotation center C0 of the charging roller 11 in the direction of the arrow R1.

When the first separation member 7 is further rotated about the rotation center C0 of the charging roller 11 in a direction of an arrow C1, as illustrated in FIG. 9C, the convex shape portion 7*e* on the phase determined portion 7*d* of the first separation member 7 completely leaves the surface 21*a* provided on the cleaning frame 21.

The surface 7*f* of the first separation member 7 on the upstream side in the rotation direction (the direction of the arrow R1) of the photosensitive drum 10 still receives the force in the direction of the arrow S1 from the surface 24*f* of the first releasing portion 24*e* disposed on the photosensitive drum 10 on the downstream side in the rotation direction (the direction of the arrow C5) of the photosensitive drum 10. Accordingly, the first separation member 7 is rotated about the rotation center C0 of the charging roller 11 in the direction of the arrow R1.

FIG. 9D illustrates a state in which the first separation member 7 is further rotated about the rotation center C0 of the charging roller 11 in the direction of the arrow C1 and the charging roller 11 is in contact with the photosensitive drum 10 at a contact portion 18 (a second position). At that time, a point 7*m* of the first separation member 7 which is a most upstream portion in the rotation direction (the direction of the arrow R1) of the first separation member 7 is in contact with a point 24*e*1 of the first releasing portion 24*e* which is a most downstream portion in the rotation direction (the direction of the arrow C5) of the photosensitive drum 10.

The charging roller 11 receives driving force from the photosensitive drum 10 (not illustrated) and is rotated about the rotation center C0 of the charging roller 11 in the direction of the arrow C1. At that time, the first separation member 7 receives force in a direction of an arrow K1 by frictional force generated between the core metal 11*c* of the charging roller 11 and the annular portion 7*a* of the first separation member 7 caused by the rotation of the charging roller 11 in the direction of the arrow C1 and the gravity G acting on the first separation member 7. Accordingly, the first separation member 7 is further rotated in the direction of the arrow R1.

When the first separation member 7 is further rotated about the rotation center C0 of the charging roller 11 in the direction of the arrow R1, as illustrated in FIG. 9E, a surface 7*k* provided on the abutment portion 7*b* on a downstream side in the rotation direction (the direction of the arrow R1) of the first separation member 7 is brought into contact with a surface 21*d* provided on the cleaning frame 21. Accordingly, the rotation of the first separation member 7 in the direction of the arrow R1 is regulated and stopped. In this regard, the first separation member 7 is rotated to a state in which the closest portion between the first releasing portion 24*e* of the photosensitive drum 10 and the abutment portion 7*b* of the first separation member 7 is separated by a distance G3.

As described above, the photosensitive drum 10 and the charging roller 11 are released from the separated state by the first separation member 7, and the photosensitive drum 10 and the charging roller 11 are brought into an abutment state. The operation of the first separation member 7 described according to the present exemplary embodiment is an example, and the present invention is not limited to the above-described configuration.

(Separation Release Timing)

Next, a separation release timing of the charging roller 11 in the longitudinal direction which is the essence of the present invention is described with reference to FIGS. 11A to 11D and FIGS. 12A to 12D. Components are not illustrated except for the photosensitive drum 10, the charging roller 11, the first releasing portion 24*e*, the second releasing portion 28*c*, the first separation member 7, and the second separation member 9 for ease of the description. Further, shapes of the phase determined portions of the first separation member 7 and the second separation member 9 are also not illustrated, however, the configurations thereof are the same as those described above.

Figure 11A:
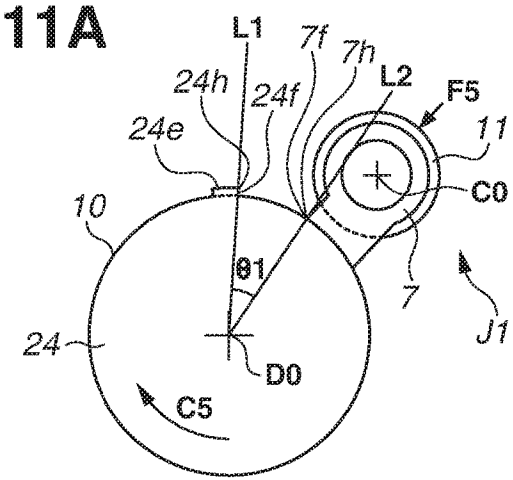
FIGS. 11A to 11D are side views illustrating separation release timings in a longitudinal direction of the charging roller.
Figure 11B:
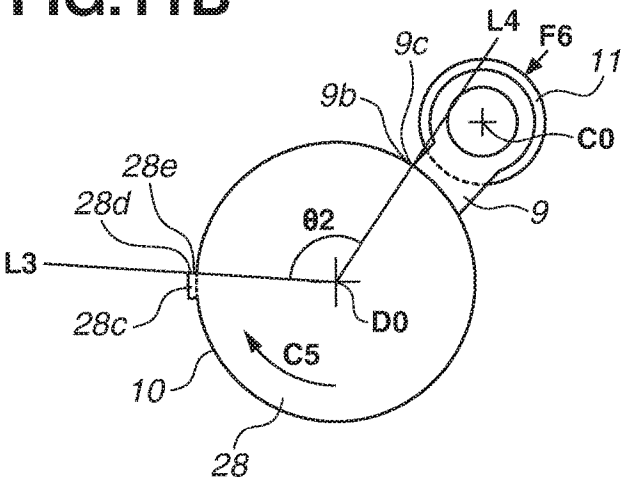

FIGS. 11A and 11B illustrate relationships of the photosensitive drum 10 and the charging roller 11 on the drive side and on the non-drive side respectively at the same timing when the photosensitive drum 10 and the charging roller 11 are in the separated state. FIGS. 11C and 11D, FIGS. 12A and 12B, and FIGS. 12C and 12D also illustrate relationships of the photosensitive drum 10 and the charging roller 11 on the drive side and on the non-drive side respectively at the same timing.

The drum cartridge C includes the first releasing portion 24*e*, the second releasing portion 28*c*, the first separation member 7, and the second separation member 9. The first releasing portion 24*e* is disposed on one end portion of the both end portions in an axial direction of the photosensitive drum 10 and moved from the first position J1 to the second position J2 by releasing a position of the charging roller 11. The second releasing portion 28*c* is disposed on another end portion of the both end portions in the axial direction of the photosensitive drum 10 and moved from the first position J1 to the second position J2 by releasing the position of the charging roller 11.

The first separation member 7 as a "first released member" is disposed on one end portion of the both end portions on the axial direction of the charging roller 11 and brought into contact with the first releasing portion 24*e* when the position of the charging roller 11 is maintained at the first position J1. The second separation member 9 as a "second released member" is disposed on another end portion of the both end portions on the axial direction of the charging roller 11 and brought into contact with the second releasing portion 28*c* when the position of the charging roller 11 is maintained at the first position J11. Regarding the drum cartridge C, a timing at which the photosensitive drum 10 is rotated and the first releasing portion 24*e* acts on the first separation member 7 is different from a timing at which the photosensitive drum 10 is rotated and the second releasing portion 28*c* acts on the second separation member 9. The configuration is described below.

As illustrated in FIG. 11A, a line connecting the rotation center D0 of the photosensitive drum 10 and a most downstream portion 24*h* is denoted by a line L1. The most downstream portion 24*h* is on the most downstream side of the surface 24*f*, which is in contact with the first separation member 7, of the first releasing portion 24*e* in the rotation direction (the direction of the arrow C5) of the photosensitive drum 10. A line connecting the rotation center D0 of the photosensitive drum 10 and a most upstream portion 7*h* is denoted by a line L2. The most upstream portion 7*h* is on the most upstream side of the surface 7*f*, which is in contact with the first releasing portion 24*e*, of the first separation member 7 in the rotation direction (the direction of the arrow R1) of the first separation member 7. Further, an angle formed by the line L1 and the line L2 is denoted by an angle θ1.

Further, as illustrated in FIG. 11B, a line connecting the rotation center D0 of the photosensitive drum 10 and a most downstream portion 28*e* is denoted by a line L3. The most downstream portion 28*e* is on the most downstream side of a surface 28*d* (a second moving portion), which is in contact with the second separation member 9, of the second releasing portion 28*c* in the rotation direction (the direction of the arrow C5) of the photosensitive drum 10. A line connecting the rotation center D0 of the photosensitive drum 10 and a most upstream portion 9*c* is denoted by a line L4. The most upstream portion 9*c* is on the most upstream side of a surface 9*b*, which is in contact with the second releasing portion 28*c*, of the second separation member 9 in the rotation direction (a direction of an arrow R2) of the second separation member 9. Further, an angle formed by the line L3 and the line L4 is denoted by an angle θ2.

The angle θ1 is smaller than the angle θ2. According to the present invention, a phase in the rotation direction of the first releasing portion 24*e* provided on the drive side flange 24 is different from that of the second releasing portion 28*c* provided on the non-drive side flange 28, and accordingly the angle θ1 is formed smaller than the angle θ2.

Figure 11C:
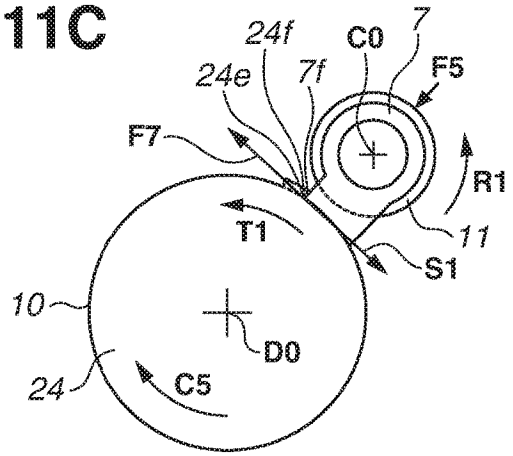

FIG. 11C illustrates a state in which the photosensitive drum 10 is rotated in the direction of the arrow C5, and the first releasing portion 24*e* provided on the drive side flange 24 is in contact with the first separation member 7.

At that time, the surface 24*f* of the first releasing portion 24*e* disposed on the downstream side in the rotation direction (the direction of the arrow C5) of the photosensitive drum 10 presses the surface 7*f* in the direction of the arrow S1. The surface 7*f* of the first separation member 7 is disposed on the upstream side in the rotation direction (the direction of the arrow C1) of the charging roller 11. Accordingly, the first separation member 7 is rotated about the rotation center C0 of the charging roller 11 in the direction of the arrow R1. At that time, the surface 24*f* of the first releasing portion 24*e* receives reaction force F7 from the surface 7*f* of the first separation member 7. The reaction force F7 generates torque T1 on the photosensitive drum 10.

Figure 11D:
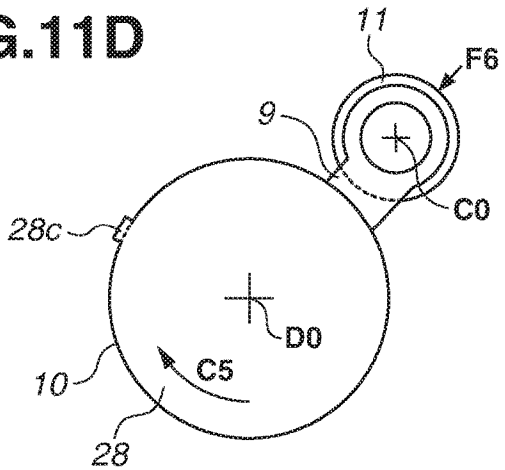

At that time, as illustrated in FIG. 11D, the second releasing portion 28*c* provided on the non-drive side flange 28 is not yet in contact with the second separation member 9. Thus, reaction force from the second separation member 9 is not generated on the non-drive side flange 28.

Figure 12A:
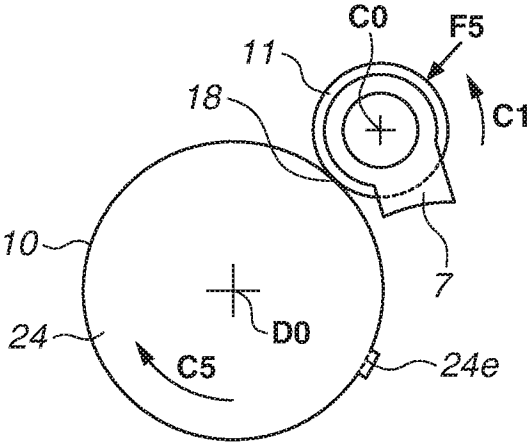
FIGS. 12A to 12D are side views illustrating separation release timings in the longitudinal direction of the charging roller.
Figure 12B:
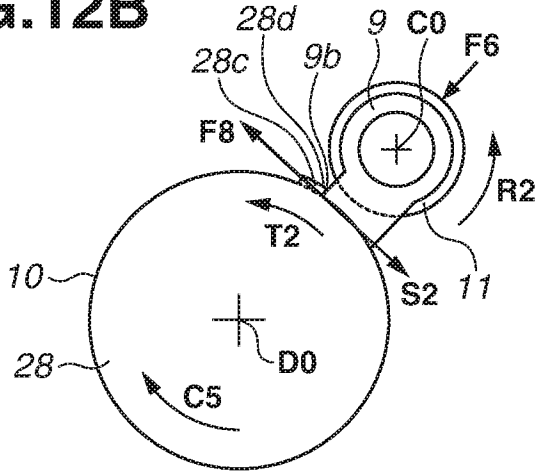

FIG. 12B illustrates a state in which the photosensitive drum 10 is further rotated, and the second releasing portion 28*c* provided on the non-drive side flange 28 is in contact with the second separation member 9. At that time, a surface 28*d* of the second releasing portion 28*c* disposed on the downstream side in the rotation direction (the direction of the arrow C5) of the photosensitive drum 10 presses the surface 9*b* in a direction of an arrow S2. The surface 9*b* of the second separation member 9 is disposed on the upstream side in the rotation direction (the direction of the arrow C1) of the charging roller 11. Accordingly, the second separation member 9 is rotated about the rotation center C0 of the charging roller 11 in the direction of the arrow R2. At that time, the surface 28*d* of the second releasing portion 28*c* receives reaction force F8 from the surface 9*b* of the second separation member 9. The reaction force F8 generates torque T2 on the photosensitive drum 10.

At that time, as illustrated in FIG. 12A, the first releasing portion 24*e* provided on the drive side flange 24 is not in contact with the first separation member 7. Thus, reaction force from the first separation member 7 is not generated on the drive side flange 24.

At that time, the first separation member 7 is rotated about the rotation center C0 of the charging roller 11 by the first releasing portion 24*e* provided on the drive side flange 24, and the rotation of the first separation member 7 is stopped (a method for stopping the rotation is not illustrated). In addition, the photosensitive drum 10 is in contact with the charging roller 11 at the contact portion 18, and the charging roller 11 is rotated in the direction of the arrow C1.

Figure 12C:
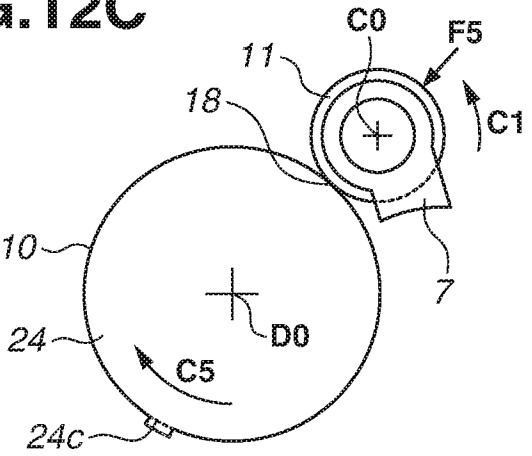
Figure 12D:
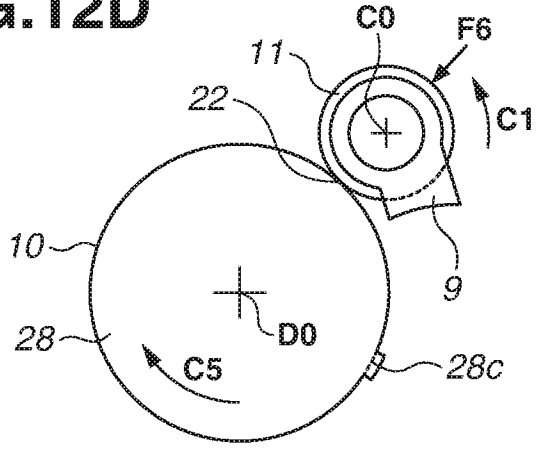

FIG. 12D illustrates a state in which the photosensitive drum 10 is further rotated, the second separation member 9 is rotated about the rotation center C0 of the charging roller 11 by the second releasing portion 28*c* provided on the non-drive side flange 28, and the rotation of the second separation member 9 is stopped (the method for stopping the rotation is not illustrated). At that time, the second releasing portion 28*c* provided on the non-drive side flange 28 is not in contact with the second separation member 9. Thus, reaction force from the second separation member 9 is not generated on the non-drive side flange 28, and the photosensitive drum 10 is in contact with the charging roller 11 at a contact portion 22. In addition, the charging roller 11 is rotated in the direction of the arrow C1.

At that time, as illustrated in FIG. 12C, the first separation member 7 disposed on the drive side remains in a state of stopping its rotation about the rotation center C0 of the charging roller 11, and the photosensitive drum 10 is in contact with the charging roller 11 at the contact portion 18. Accordingly, the photosensitive drum 10 and the charging roller 11 are released from the separated state by the first separation member 7 and the second separation member 9.

As described above, the angle θ1 and the angle θ2 are set to different angles, and thus timings when the reaction force F7 received from the first separation member 7 and the reaction force F8 received from the second separation member 9 are generated with respect to the photosensitive drum 10 can be shifted. Accordingly, generation timings of the torque T1 and the torque T2 can be shifted which are generated with respect to the photosensitive drum 10 when the separation of the charging roller 11 from the photosensitive drum 10 is released. In other words, a peak value of a load applied to the photosensitive drum 10 can be reduced. According to the present exemplary embodiment, the angles are set to be θ1<θ2, however, the similar effect can be obtained if the angles are set to be θ1>θ2 as long as θ1≠θ2 is satisfied. "θ1≠θ2 is satisfied" means that the surface 24*f* and the surface 28*d* are placed on different positions with respect to the circumferential direction centering on the axis line (D0) of the photosensitive drum 10 when viewed from the axial direction of the photosensitive drum 10 (FIGS. 11A to 11D and the like).

Figure 13A:
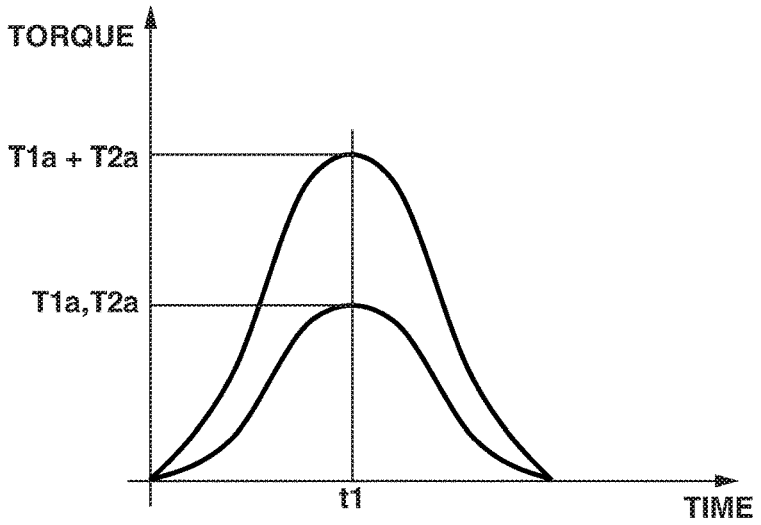
FIG. 13A is a graph of torque generated in the photosensitive drum when a separation release by the first separation member and a separation release by a second separation member are performed at the same time.
Figure 13B:
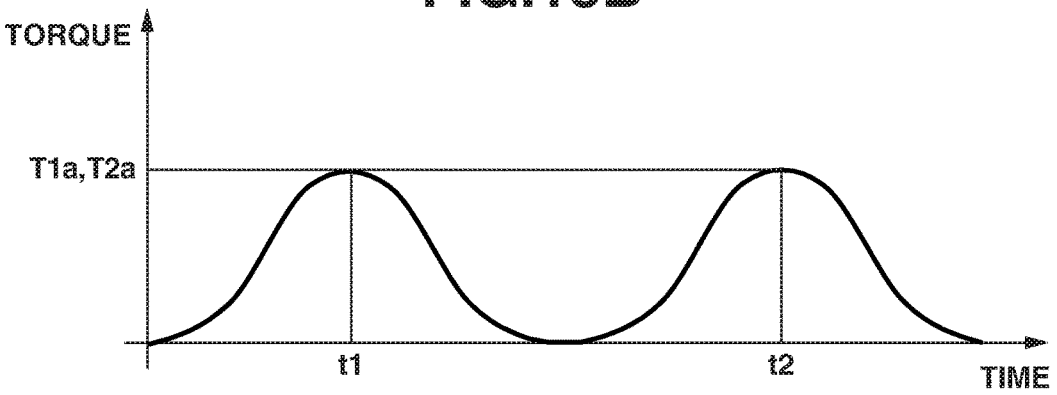
FIG. 13B is a graph of torque generated in the photosensitive drum when a separation release by the first separation member 7 and a separation release by the second separation member are performed by completely shifting timings from each other.
Figure 13C:
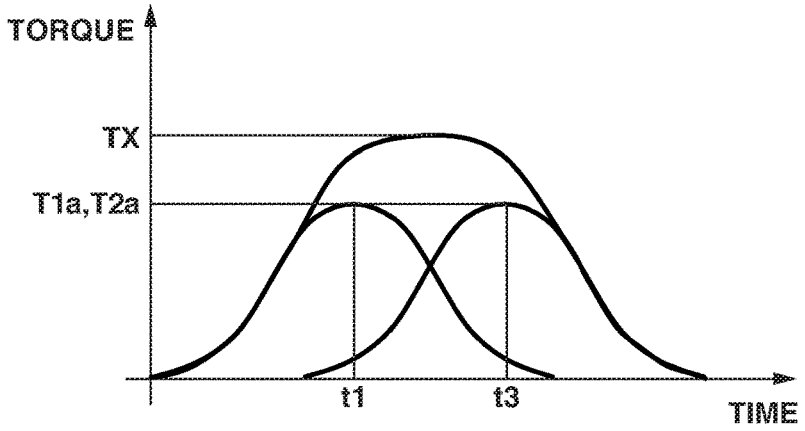
FIG. 13C is a graph of torque generated in the photosensitive drum when a separation release by the first separation member and a separation release by the second separation member are performed by shifting timings at which a peak value of the torque is appeared.

The description so far is summarized with reference to FIGS. 13A to 13C. FIG. 13A is a graph of torque generated on the photosensitive drum 10 when the separation release by the first separation member 7 and the separation release by the second separation member 9 are performed at the same time. FIG. 13B is a graph of torque generated on the photosensitive drum 10 when the separation release by the first separation member 7 and the separation release by the second separation member 9 are performed at the timing completely shifted from each other. FIG. 13C is a graph of torque generated on the photosensitive drum 10 when the separation release by the first separation member 7 and the separation release by the second separation member 9 are performed by shifting timings at which a peak value of the torque is appeared.

When the separation release by the first separation member 7 is performed, a peak value of torque generated on the photosensitive drum 10 is denoted by T1*a*. Further, when the separation release by the second separation member 9 is performed, a peak value of torque generated on the photosensitive drum 10 is denoted by T2*a*. For convenience of the description, the values are regarded as T1*a*=T2*a*.

As illustrated in FIG. 13A, when the separation release by the first separation member 7 and the separation release by the second separation member 9 are performed at the same time, the peak value of the torque generated on the photosensitive drum 10 is T1*a*+T2*b*. In contrast, when the separation release by the first separation member 7 and the separation release by the second separation member 9 according to the present exemplary embodiment are performed at the timings completely shifted from each other, the peak value of the torque generated on the photosensitive drum 10 is T1*a* (T2*a*), so that the peak value of the torque can be reduced.

According to the present exemplary embodiment, the case is described in which the separation release by the first separation member 7 and the separation release by the second separation member 9 are performed at the timings completely shifted from each other. However, as illustrated in FIG. 13C, the peak value of the torque generated on the photosensitive drum 10 in the case where the timings at which the peak value of the torque is generated are shifted between the separation release by the first separation member 7 and the separation release by the second separation member 9 is denoted by TX. In this case, TX is expressed as T1*a* (T2*a*)<TX<T1*a*+T2*a*. Therefore, as illustrated in FIG. 13C, an effect of reducing the peak value of the torque can be obtained when the timings at which the peak value of the torque is generated are shifted between the separation release by the first separation member 7 and the separation release by the second separation member 9.

As described above, if the separation release by the first separation member 7 is shifted from the separation release by the second separation member 9, the peak value of the torque can be reduced. Accordingly, the load applied to the motor to rotate the photosensitive drum 10 can be reduced. In other words, enlargement of the motor and operation sound can be suppressed.

According to a second exemplary embodiment, phases of the first releasing portion 24*e* and the second releasing portion 28*c* provided on the photosensitive drum 10 are changed from each other, and thus the angle θ1 and the angle θ2 are differentiated from each other. However, as illustrated in FIGS. 14A and 14B, a shape of a first separation member 19 disposed on the drive side is changed from that of a second separation member 20 disposed on the non-drive side, and thus an angle θ3 may be differentiated from an angle θ4.

Figure 14A:
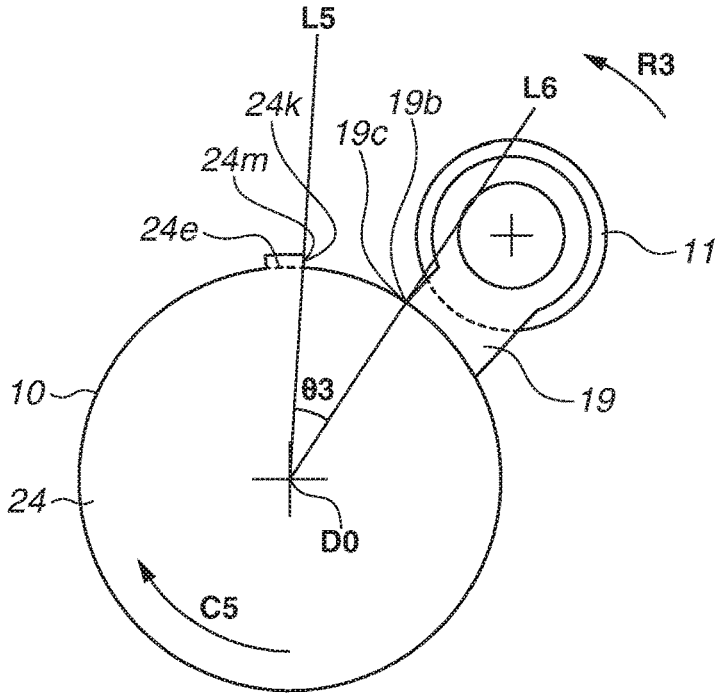
FIGS. 14A and 14B are side views illustrating an operation relationship between a drive side flange and the first separation member and an operation relationship between a non-drive side flange and the second separation member.

FIG. 14A illustrates a relationship of the drive side flange 24 and the first separation member 19 when the photosensitive drum 10 and the charging roller 11 are in the separated state by the first separation member 19. Further, FIG. 14B illustrates a relationship of the non-drive side flange 28 and the second separation member 20 when the photosensitive drum 10 and the charging roller 11 are in the separated state by the second separation member 20. The drive side flange 24 and the non-drive side flange 28 have the same configurations as described above. The first releasing portion 24*e* and the second releasing portion 28*c* have the same shape.

Figure 14B:
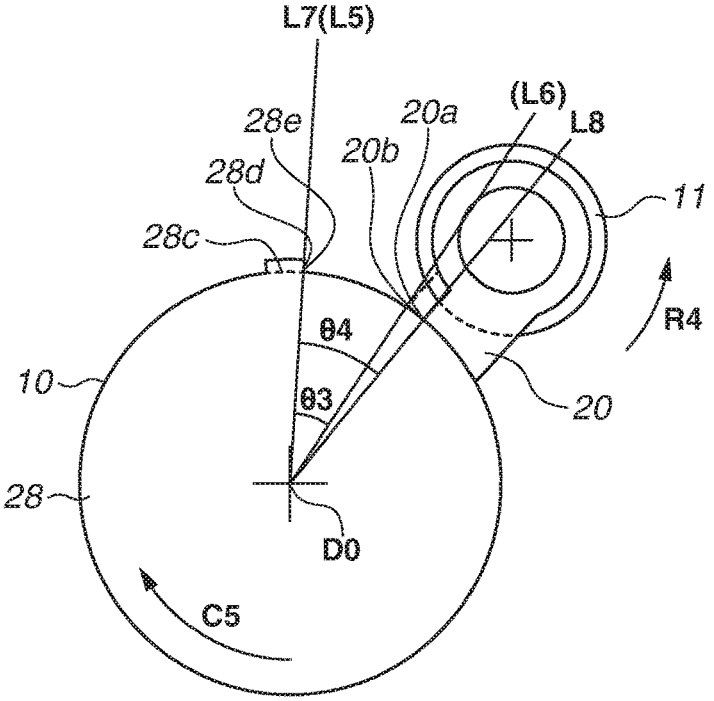

In FIGS. 14A and 14B, the first releasing portion 24*e* provided on the drive side flange 24 and the second releasing portion 28*c* provided on the non-drive side flange 28 are arranged in the same phase. Further, a surface 20*a*, which is in contact with the second releasing portion 28*c*, of the second separation member 20 disposed on the non-drive side has a shape dented in the rotation direction (the direction of the arrow C5) of the photosensitive drum 10 with respect to a surface 19*b*, which is in contact with the first releasing portion 24*e*, of the first separation member 19 disposed on the drive side.

As illustrated in FIG. 14A, a line connecting the rotation center D0 of the photosensitive drum 10 and a most downstream portion 24*m* is denoted by a line L5. The most downstream portion 24*m* is on the most downstream side of a surface 24*k*, which is in contact with the first separation member 19, of the first releasing portion 24*e* in the rotation direction (the direction of the arrow C5) of the photosensitive drum 10. Further, a line connecting the rotation center D0 of the photosensitive drum 10 and a most upstream portion 19*c* is denoted by a line L6. The most upstream portion 19*c* is on the most upstream side of the surface 19*b*, which is in contact with the first releasing portion 24*e*, of the first separation member 19 in the rotation direction (a direction of an arrow R3) of the first separation member 19. Further, an angle formed by the line L5 and the line L6 is denoted by the angle θ3.

As illustrated in FIG. 14B, a line connecting the rotation center D0 of the photosensitive drum 10 and the most downstream portion 28*e* is denoted by a line L7. The most downstream portion 28*e* is on the most downstream side of the surface 28*d*, which is in contact with the second separation member 20, of the second releasing portion 28*c* in the rotation direction (the direction of the arrow C5) of the photosensitive drum 10. Further, a line connecting the rotation center D0 of the photosensitive drum 10 and a most upstream portion 20*b* is denoted by a line L8. The most upstream portion 20*b* is on the most upstream side of the surface 20*a*, which is in contact with the second releasing portion 28*c*, of the second separation member 20 in the rotation direction (a direction of an arrow R4) of the second separation member 20. Further, an angle formed by the line L7 and the line L8 is denoted by the angle θ4. In this regard, the angle θ3 is formed smaller than the angle θ4.

As described above, according to the present invention, the angle θ3 and the angle θ4 can be different angles by changing the shape of the first separation member 19 disposed on the drive side and the shape of the second separation member 20 disposed on the non-drive side. According to the present exemplary embodiment, the angles are set to be θ3<θ4, however, the similar effect can be obtained if the angles are set to be θ3>θ4 as long as θ3≠θ4 is satisfied.

Figure 15:
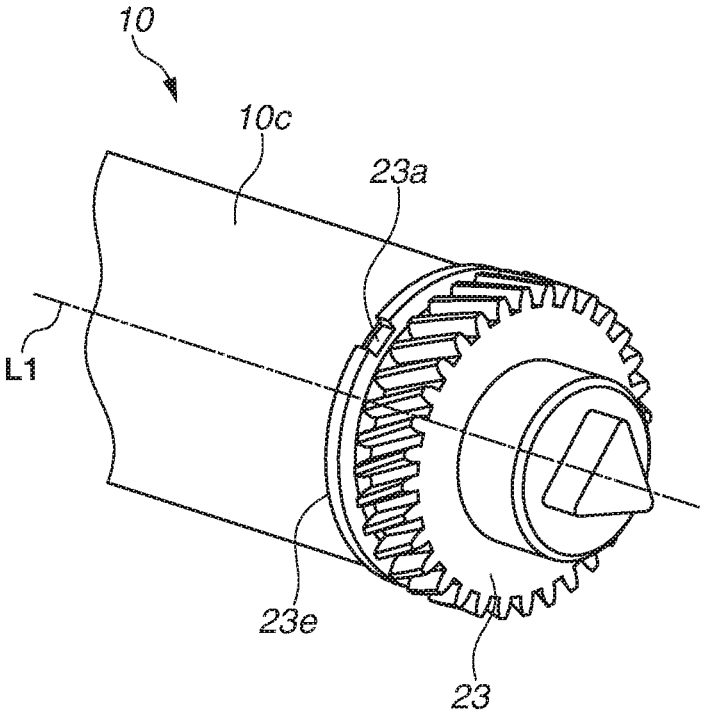
FIG. 15 is a perspective view of the photosensitive drum viewed from the drive side flange side.

Further, the shape of the releasing portion may not be a convex shape protruding from the surface of the photosensitive member 10*c*. In FIG. 15, a first releasing portion 23*a* having a concave shape dented to the inside in a radius direction of the photosensitive member 10*c* is provided on an abutment surface 23*e* of the drive side flange 23 with respect to the photosensitive member 10*c* in the longitudinal direction.

Figure 16A:
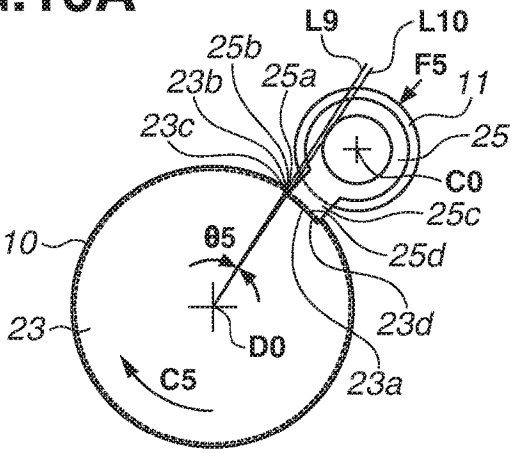
FIGS. 16A to 16D are side views of configuration examples when a configuration of a releasing portion is used which is dented to the inside in a radius direction of the photosensitive member illustrated in FIG. 15.
Figure 16B:
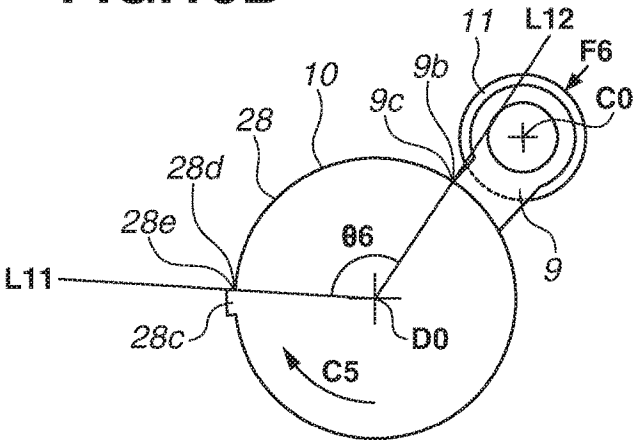

FIGS. 16A to 16D and FIGS. 17A to 17D illustrate configuration examples when the configuration of the releasing portion is used which is dented to the inside in the radius direction of the photosensitive member 10 illustrated in FIG. 15. In the configuration examples illustrated in FIGS. 16A to 16D and FIGS. 17A to 17D, the first releasing portion 23*a* having the concave shape formed on the drive side flange 23 and the second releasing portion 28*c* having the convex shape formed on the non-drive side flange 28 are arranged. As illustrated in FIG. 16B, the non-drive side flange 28 and the second separation member 9 disposed on the non-drive side have the same configurations as described above.

Components are not illustrated except for the photosensitive drum 10, the charging roller 11, the first releasing portion 23*a*, the second releasing portion 28*c*, a first separation member 25, and the second separation member 9 for ease of the description. Further, shapes of the phase determined portions of the first separation member 25 and the second separation member 9 are also not illustrated, however, the configurations thereof are the same as those described above.

FIGS. 16A and 16B illustrate relationships of the photosensitive drum 10 and the charging roller 11 on the drive side and on the non-drive side respectively at the same timing when the photosensitive drum 10 and the charging roller 11 are in the separated state. FIGS. 16C and 16D, FIGS. 17A and 17B, and FIGS. 17C and 17D also illustrate relationships of the photosensitive drum 10 and the charging roller 11 on the drive side and on the non-drive side respectively at the same timing.

As illustrated in FIG. 16A, when the photosensitive drum 10 and the charging roller 11 are in the separated state, an abutment surface 25*d* of an abutment portion 25*c* on the first separation member 25 disposed on the drive side abuts on a surface 23*d* having a concave shape formed on the first releasing portion 23*a*. Thus, the charging roller 11 is separated from the photosensitive drum 10. At that time, the charging roller 11 is urged in the direction toward the photosensitive drum 10 by the urging force F5 applied by the urging member 68*a* (not illustrated).

In this regard, a line connecting the rotation center D0 of the photosensitive drum 10 and a most downstream portion 23*c* is denoted by a line L9. The most downstream portion 23*c* is on the most downstream side of a surface 23*b*, which is in contact with the first separation member 25, of the first releasing portion 23*a* provided on the drive side flange 23 in the rotation direction (the direction of the arrow C5) of the photosensitive drum 10. Further, a line connecting the rotation center D0 of the photosensitive drum 10 and a most downstream portion 25*b* is denoted by a line L10. The most downstream portion 25*b* is on the most downstream side of a surface 25*a*, which is in contact with the first releasing portion 23*a*, of the first separation member 25 in the rotation direction (a direction of an arrow R5) of the first separation member 25. Further, an angle formed by the line L9 and the line L10 is denoted by an angle θ5.

As illustrated in FIG. 16B, a line connecting the rotation center D0 of the photosensitive drum 10 and the most downstream portion 28*e* is denoted by a line L11. The most downstream portion 28*e* is on the most downstream side of the surface 28*d*, which is in contact with the second separation member 9, of the second releasing portion 28*c* provided on the non-drive side flange 28 in the rotation direction (the direction of the arrow C5) of the photosensitive drum 10. A line connecting the rotation center D0 of the photosensitive drum 10 and the most upstream portion 9*c* is denoted by a line L8. The most upstream portion 9*c* is on the most upstream side of the surface 9*b*, which is in contact with the second releasing portion 28*c*, of the second separation member 9 in the rotation direction (a direction of an arrow R6) of the second separation member 9. Further, an angle formed by the line L11 and the line L12 is denoted by an angle θ6. According to the present exemplary embodiment, the angle θ5 is formed smaller than the angle θ6.

Figure 16C:
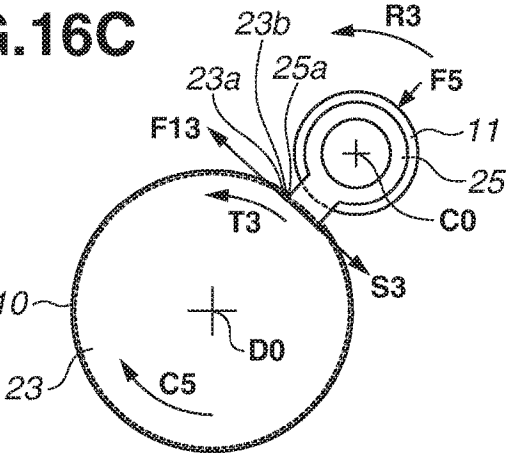

FIG. 16C illustrates a state in which the photosensitive drum 10 is rotated in the direction of the arrow C5, and the surface 23*b* of the first releasing portion 23*a* of the drive side flange 23 which is on the upstream side in the rotation direction (the direction of the arrow C5) of the photosensitive drum 10 is in contact with the surface 25*a* on the upstream side in the rotation direction (the direction of the arrow R3) of the first separation member 25.

The surface 23*b* of the first releasing portion 23*a* presses the surface 25*a* of the first separation member 25 in a direction of an arrow S3. Accordingly, the first separation member 25 is rotated about the rotation center C0 of the charging roller 11 in the direction of the arrow R3. At that time, the surface 23*b* of the first releasing portion 23*a* receives reaction force F13 from the surface 25*a* of the first separation member 25. The reaction force F13 generates torque T3 on the photosensitive drum 10.

Figure 16D:
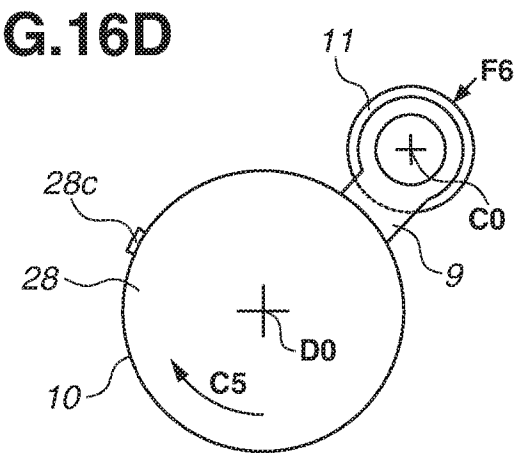

At that time, as illustrated in FIG. 16D, the second releasing portion 28*c* provided on the non-drive side flange 28 is not yet in contact with the second separation member 9. Thus, reaction force from the second separation member 9 is not generated on the non-drive side flange 28.

Figure 17A:
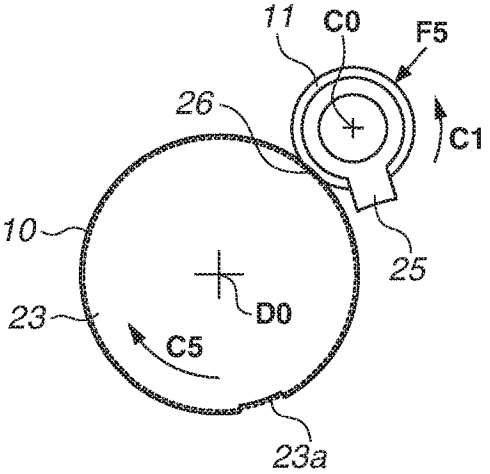
FIGS. 17A to 17D are side views of configuration examples when the configuration of the releasing portion is used which is dented to the inside in the radius direction of the photosensitive member illustrated in FIG. 15.
Figure 17B:
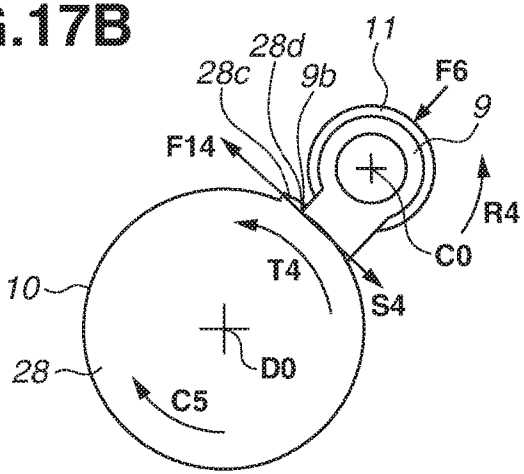

FIG. 17B illustrates a state in which the photosensitive drum 10 is further rotated, and the second releasing portion 28*c* provided on the non-drive side flange 28 is brought into contact with the second separation member 9.

The surface 28*d* of the second releasing portion 28*c* disposed on the downstream side in the rotation direction (the direction of the arrow R4) of the second separation member 9 presses the surface 9*b* of the second separation member 9 disposed on the upstream side in the rotation direction (the direction of the arrow R4) of the second separation member 9 in a direction of an arrow S4. Accordingly, the second separation member 9 is rotated about the rotation center C0 of the charging roller 11 in the direction of the arrow R4. At that time, the surface 28*d* of the second releasing portion 28*c* receives reaction force F14 from the surface 9*b* of the second separation member 9. The reaction force F14 generates torque T4 on the photosensitive drum 10.

At that time, as illustrated in FIG. 17A, the first releasing portion 23*a* provided on the drive side flange 23 is not in contact with the first separation member 25. Thus, reaction force from the first separation member 25 is not generated on the drive side flange 23.

At that time, the first separation member 25 is rotated about the rotation center C0 of the charging roller 11 by the first releasing portion 23*a* provided on the drive side flange 23, and the rotation of the first separation member 25 is stopped (the method for stopping the rotation is not illustrated). In addition, the photosensitive drum 10 is in contact with the charging roller 11 at a contact portion 26, and the charging roller 11 is rotated in the direction of the arrow C1.

Figure 17C:
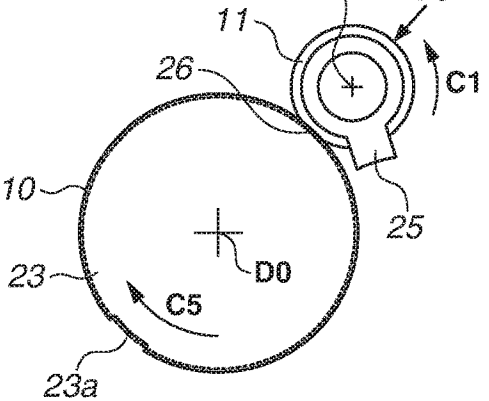
Figure 17D:
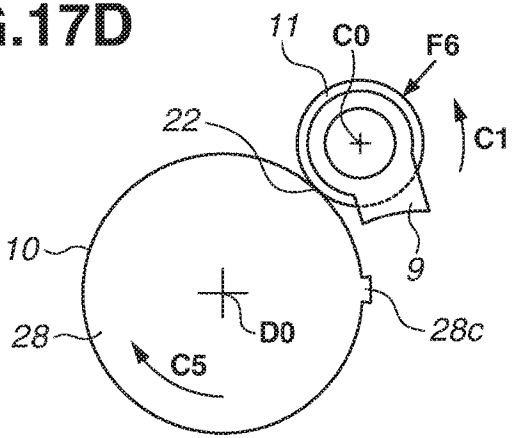

FIG. 17D illustrates a state in which the photosensitive drum 10 is further rotated, the second separation member 9 is rotated about the rotation center C0 of the charging roller 11 by the second releasing portion 28*c* provided on the non-drive side flange 28, and the rotation of the second separation member 9 is stopped (the method for stopping the rotation is not illustrated).

At that time, the second releasing portion 28*c* provided on the non-drive side flange 28 is not in contact with the second separation member 9. Thus, reaction force from the second separation member 9 is not generated on the non-drive side flange 28, and the photosensitive drum 10 is in contact with the charging roller 11 at the contact portion 22. In addition, the charging roller 11 is rotated in the direction of the arrow C1.

At that time, as illustrated in FIG. 17C, the first separation member 25 disposed on the drive side remains in a state of stopping its rotation about the rotation center C0 of the charging roller 11, and the photosensitive drum 10 is in contact with the charging roller 11 at the contact portion 26. Accordingly, the photosensitive drum 10 and the charging roller 11 are released from the separated state by the first separation member 25 and the second separation member 9.

As described above, an angle θ5 is formed smaller than an angle θ6, and thus timings when the reaction force F13 received from the first separation member 25 and the reaction force F14 received from the second separation member 9 are generated with respect to the photosensitive drum 10 can be shifted. Accordingly, generation timings of the torque T3 and the torque T4 can be shifted which are generated with respect to the photosensitive drum 10 when the separation of the charging roller 11 from the photosensitive drum 10 is released. In other words, a peak value of a load applied to the photosensitive drum 10 can be reduced. Therefore, according to the present invention, if the first releasing portion 23*a* has a concave shape dented to the inside in the radius direction of the photosensitive member 10*c*, the effect of the invention can be obtained.

As described above, a contact timing of the releasing portion disposed on one end of the charging roller in the longitudinal direction and the separation member is set after the releasing portion disposed on the other end is brought into contact with the separation member, and the separation member is separated from the surface of the photosensitive drum. Accordingly, the cartridge adopting the present invention can reduce a peak value of a load generated when the separated state is released by a user to start use of the cartridge. Therefore, enlargement of the motor and operation sound can be suppressed. According to the present exemplary embodiment, the angles are set to be θ5<θ6, however, the similar effect can be obtained if the angles are set to be θ5>θ6 as long as θ5≠θ6 is satisfied.

The configuration according to the first exemplary embodiment or the second exemplary embodiment can reduce a load to the photosensitive drum 10 which is applied when the separated state of the process unit, such as the charging roller 11, with respect to the photosensitive drum 10 is released. Accordingly, the configuration can suppress enlargement of the motor and operation sound. The process unit may be the developing roller 13 for bearing a developer and the transfer roller 6 to which a toner image on the photosensitive drum 10 is transferred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-038380, filed Feb. 27, 2015, which is hereby incorporated by reference herein in its entirety.

What is claimed is:

1. A cartridge including an image bearing member and a rotatable charging roller for charging the image bearing member and capable of moving the charging roller from a first position to a second position closer to the image bearing member than the first position, the cartridge comprising:

a first maintaining member and a second maintaining member, disposed on respective end portions of the charging roller in an axial direction of the charging roller, the first and second maintaining members being configured to maintain a position of the charging roller at the first position by contacting with the respective end portions of the image bearing member; and a first moving portion and a second moving portion, disposed on respective end portions of the image bearing member in an axial direction of the image bearing member, the first and second moving portions being configured to rotate about a rotational axis of the image bearing member and contact with and move the first maintaining member and the second maintaining member, respectively, according to a rotation of the image bearing member so as to move the charging roller from the first position to the second position, wherein a contacting portion of the first maintaining member contacting with the first moving portion and a contacting portion of the second maintaining member contacting with the second moving portion are disposed on same positions with respect to a circumferential direction centering on an axis line of the image bearing member when the charging member is at first position and viewed from the axial direction of the image bearing member, and wherein, in a case where the image bearing member is rotated in a state in which the charging roller is in the first position, the first moving portion abuts on the first maintaining member, and then the second moving portion abuts on the second maintaining member.

2. The cartridge according to claim 1, further comprising an urging member configured to urge the charging roller toward the image bearing member.

3. The cartridge according to claim 2, wherein the urging member urges both end portions of the charging roller in the axial direction.

4. The cartridge according to claim 1, wherein, when the second moving portion abuts on the second maintaining member, the first moving portion does not abut on the first maintaining member.

5. A cartridge including an image bearing member and a rotatable charging roller for charging the image bearing member and capable of moving the charging roller from a first position to a second position closer to the image bearing member than the first position, the cartridge comprising:

a first maintaining member and a second maintaining member, disposed on respective end portions of the charging roller in an axial direction of the charging roller, the first and second maintaining members being configured to maintain a position of the charging roller at the first position by contacting with the respective end portions of the image bearing member; and a first moving portion and a second moving portion, disposed on respective end portions of the image bearing member in an axial direction of the image bearing member, the first and second moving portions being configured to rotate about a rotational axis of the image bearing member and contact with and move the first maintaining member and the second maintaining member, respectively, according to a rotation of the image bearing member so as to move the charging roller from the first position to the second position, wherein a contacting portion of the first maintaining member contacting with the first moving portion and a contacting portion of the second maintaining member contacting with the second moving portion are disposed on same positions with respect to a circumferential direction centering on an axis line of the image bearing member when the charging member is at first position and viewed from the axial direction of the image bearing member, and wherein the first moving portion and the second moving portion are disposed on different positions with respect to a circumferential direction centering on an axis line of the image bearing member when viewed from the axial direction of the image bearing member.

6. The cartridge according to claim 5, further comprising an urging member configured to urge the charging roller toward the image bearing member.

7. The cartridge according to claim 6, wherein the urging member urges both end portions of the charging roller in the axial direction of the charging roller.

8. The cartridge according to claim 5, wherein, when the second moving portion abuts on the second maintaining member, the first moving portion does not abut on the first maintaining member.

9. A cartridge including an image bearing member and a process member acting on the image bearing member and capable of moving the process member from a first position to a second position closer to the image bearing member than the first position, the cartridge comprising:

a first maintaining member and a second maintaining member, disposed on respective end portions of the process member in a longitudinal direction, the first and second maintaining members being configured to maintain a position of the process member at the first position by contacting with respective end portions of the image bearing member; and a first moving portion and a second moving portion disposed on respective end portions of the image bearing member in an axial direction of the image bearing member, the first and second moving portions being configured to rotate about a rotational axis of the image bearing member and contact with and move the first maintaining member and the second maintaining member, respectively, according to a rotation of the image bearing member so as to move the process member from the first position to the second position, wherein a contacting portion of the first maintaining member contacting with the first moving portion and a contacting portion of the second maintaining member contacting with the second moving portion are disposed on same positions with respect to a circumferential direction centering on an axis line of the image bearing member when the process member is at first position and viewed from the axial direction of the image bearing member, and wherein, in a case where the image bearing member is rotated in a state in which the process member is in the first position, the first moving portion abuts on the first maintaining member, and then the second moving portion abuts on the second maintaining member.

10. The cartridge according to claim 9, further comprising an urging member configured to urge the process member toward the image bearing member.

11. The cartridge according to claim 10, wherein the urging member urges both end portions of the process member in the longitudinal direction.

12. The cartridge according to claim 9, wherein, when the second moving portion abuts on the second maintaining member, the first moving portion does not abut on the first maintaining member.

13. The cartridge according to claim 9, wherein the process member is a developing roller for bearing a developer.

14. The cartridge according to claim 9, wherein the process member is a transfer roller to which a toner image on the image bearing member is transferred.

* * * * *